US010179458B2

(12) United States Patent
Prasad et al.

(10) Patent No.: US 10,179,458 B2
(45) **Date of Patent: *Jan. 15, 2019**

(54) INKJET PRINTING SYSTEM

(71) Applicants: Archroma IP GmbH, Reinach (CH); Ink-Situ AG, Muttenz (CH)

(72) Inventors: Anjani Prasad, Kasarvadavali (IN); Juan María Lara, Barcelona (ES); Rune Jervidalo, Muttenz (CH); Rainer Roesch, Neuenburg/Rhein (DE)

(73) Assignee: Archroma IP GmbH, Reinach (CH)

( * ) Notice: Subject to any disclaimer, the term of this patent is extended or adjusted under 35 U.S.C. 154(b) by 0 days.

This patent is subject to a terminal disclaimer.

(21) Appl. No.: 15/724,509

(22) Filed: Oct. 4, 2017

(65) Prior Publication Data

US 2018/0086085 A1 Mar. 29, 2018

Related U.S. Application Data

(63) Continuation of application No. 15/037,319, filed as application No. PCT/EP2014/003078 on Nov. 18, 2014, now Pat. No. 9,833,999.

(30) Foreign Application Priority Data

Nov. 19, 2013 (EP) ..... 13005433
Sep. 29, 2014 (EP) ..... 14003361

(51) Int. Cl.
*B41J 2/175* (2006.01)
*B41J 2/18* (2006.01)
*B41J 2/195* (2006.01)

(52) U.S. Cl.
CPC ..... *B41J 2/175* (2013.01); *B41J 2/18* (2013.01); *B41J 2/195* (2013.01)

(58) Field of Classification Search
CPC .... B41J 2/175; B41J 2/17503; B41J 2/17506; B41J 2/17509; B41J 2/1752; B41J 2/18;
(Continued)

(56) References Cited

U.S. PATENT DOCUMENTS 3,930,258 A * 12/1975 Dick ..... B41J 2/175 137/408
4,614,953 A 9/1986 La Peyre
(Continued)

FOREIGN PATENT DOCUMENTS

EP 0613927 A2 9/1994
EP 1935652 A1 6/2008
(Continued)

OTHER PUBLICATIONS

International Search Report and Written Opinion dated Mar. 19, 2015, issued in PCT/EP2014/003078.

*Primary Examiner* — Anh T. N. Vo
(74) *Attorney, Agent, or Firm* — McBee Moore Woodward & Vanik IP, LLC

(57) ABSTRACT

A formulation unit for an inkjet printing machine, wherein the inkjet printing machine comprises a printing unit with a printing device and with an ink supply device for supplying ink to the printing device. The formulation unit comprises at least one preparation device for the preparation of ink and at least one storage tank for storing prepared ink.

20 Claims, 18 Drawing Sheets

(58) Field of Classification Search
CPC ... B41J 2/195; B41J 2/21; B41J 2/2107; B41J 2/211; B41M 5/0047; B41M 5/0088; B41M 5/0356; B41M 5/392; C09D 11/40; C09D 17/0017
See application file for complete search history.

(56) References Cited

U.S. PATENT DOCUMENTS 4,860,027 A 8/1989 Ozelis et al.
4,862,192 A 8/1989 Slomiannv
4,908,638 A * 3/1990 Albosta ..... B41J 2/2132 347/22
5,418,557 A 5/1995 Pullen
5,424,766 A 6/1995 Anderson
5,583,544 A 12/1996 Stamer et al.
6,003,965 A 12/1999 Arway et al.
6,059,405 A 5/2000 Mochizuki et al.
6,084,617 A * 7/2000 Balazer ..... B41J 2/17556 347/7
6,168,268 B1 * 1/2001 Sugiyama ..... B41J 2/17509 347/89
6,213,596 B1 4/2001 Nowell, Jr. et al.
6,352,324 B1 3/2002 Pagnon
6,631,983 B2 10/2003 Romano, Jr. et al.
6,665,095 B1 12/2003 Janssen et al.
7,347,540 B2 3/2008 Piock et al.
7,699,451 B2 4/2010 Nishida
8,388,121 B2 * 3/2013 Tamada ..... B41J 2/17509 347/84
9,244,389 B2 1/2016 Sandler et al.
9,833,999 B2 * 12/2017 Prasad ..... B41J 2/175

FOREIGN PATENT DOCUMENTS

JP 2001130021 A 5/2001
JP 2006082523 A 3/2006
JP 2012006316 A 1/2012
JP 2012126001 A 7/2012
WO 9709176 A1 3/1997
WO 0044569 A2 8/2000
WO 2012105938 A1 8/2012

* cited by examiner

INKJET PRINTING SYSTEM

CROSS REFERENCES TO RELATED APPLICATIONS

This is a continuation application of application Ser. No. 15/037,319, filed on May 17, 2016, which is a national stage application of PCT/EP2014/003078, filed on Nov. 18, 2014, which claims priority of European Application No. EP14003361.4, filed on Sep. 29, 2014, and European Application No. EP13005433.1, filed on Nov. 19, 2013. This application claims the priorities and benefits of all these prior applications and incorporates these prior applications by reference in their entireties.

BACKGROUND

Field of the Invention

The invention relates to an inkjet printing system, in particular to an inkjet printing machine and to a formulation unit for an inkjet printing machine and to a method for preparing ink for the inkjet printing system.

It is state of the art that ink for inkjet printing machines is prepared from specialised ink manufacturers in ink production plants with an output capacity between 50 and 300 liter per batch. With these production facilities only one colour is produced at a time. Because of the large batches often corrections have to be made to the ink to achieve the correct rheology. After the preparation of every batch the facility has to be cleaned for the next colour. The ink, which consists to 50-60% of water is filled in usually 5 or 10-liter shipping canisters and is sent all over the world. Since most manufacturers promise a 2-year shelf time the ink needs to be stabilised with a high level of solvent and for some type of ink anti-fungi chemicals to make it stable.

Another disadvantage of current ink supply is that the ink in the shipping canisters contains a large number of air bubbles which may lead to misprints. There have been attempts to sell degassed ink in vacuum bags, but this requires a high logistical effort.

SUMMARY

Therefore one problem to be solved by the present invention is to reduce logistical efforts for supplying ink to printing systems. Additionally, the quality of the ink as to air bubbles and required solvent and anti-fungi chemicals should be increased.

According to a first aspect of the invention, the problem is solved by a formulation unit for an inkjet printing machine, wherein the inkjet printing machine comprises a printing unit with a printing device and with an ink supply device for supplying ink to the printing device. The formulation unit comprises at least one preparation device for the preparation of the ink and at least one storage tank for storing prepared ink. The at least one storage tank is connectable to the supply device of the printing device for supplying ink from the storage tank to the printing device.

DETAILED DESCRIPTION OF A PREFERRED EMBODIMENT

Figure 1:
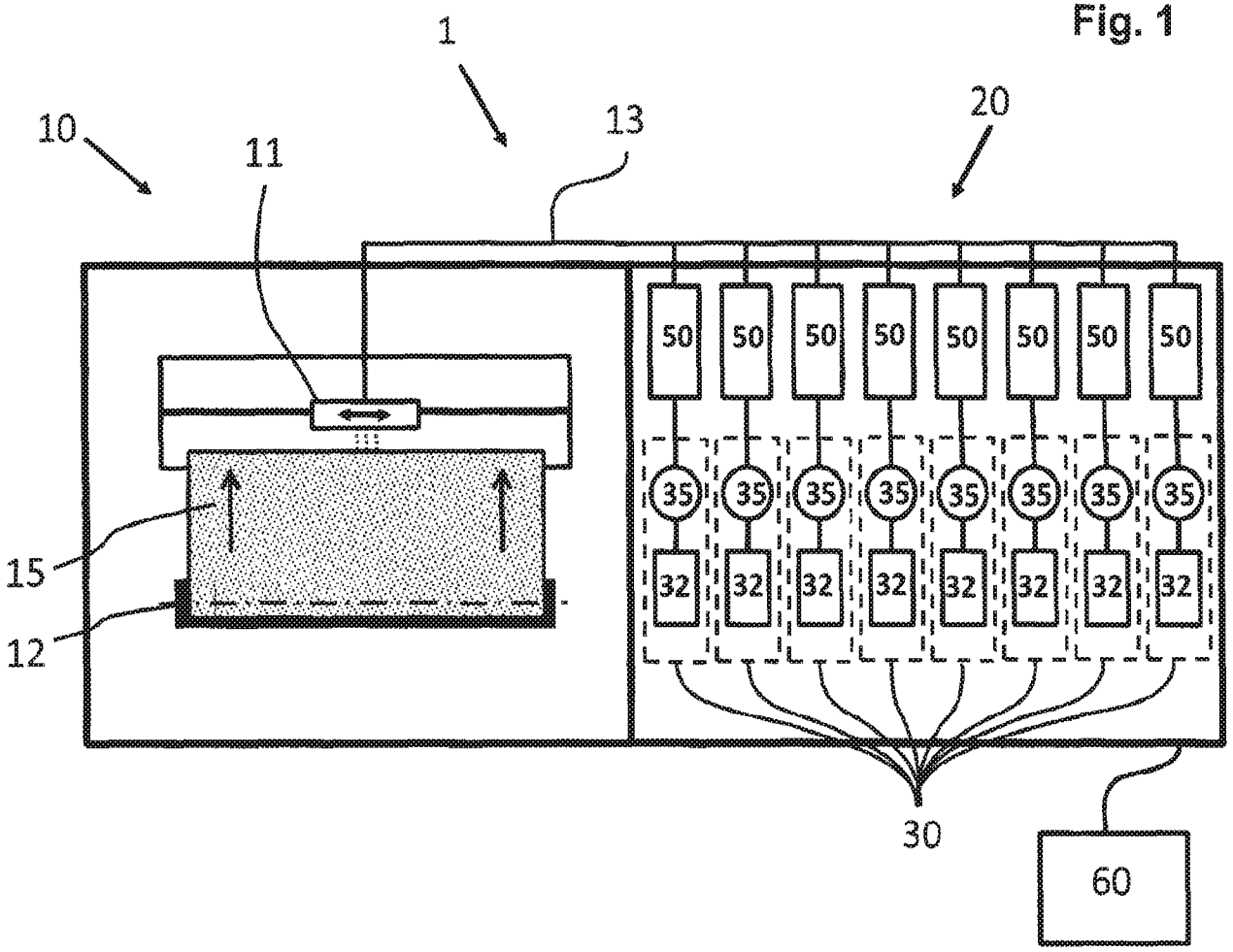
FIGS. 1-18 depict embodiments as described herein.

As the storage tank of the formulation unit is connectable to the supply device of the printing unit, the ink does not have to be filled in canisters and to be shipped to the printing machine. In this way it is possible to prepare the ink when it is needed in the printing process and in particular also in a lower quantity. Thus fewer chemicals for preserving the ink are necessary. As the ink is not shipped in form of a water suspension the quality and in particular the colour brilliance of the ink is higher and furthermore the logistic costs for providing the ink can be reduced.

A further embodiment of the formulation unit comprises at least two preparation devices and at least two storage tanks connected to said preparation devices, for the preparation and the storage of the same or respectively different inks. Such an embodiment allows for example to prepare two or more ink colours at the same time. It is also possible to produce besides different colours also different kinds of ink or other chemicals (here also referred to as "ink"), for instance for a treatment of the substrate. As it is provided in an advantageous embodiment that every preparation device serves for the preparation of one ink it is not necessary to clean the preparation device after every ink preparation procedure, inducing less water consumption for cleaning. It is considered suitable to clean the preparing device approximately every 2 to 4 weeks of machine time, which means very easy maintenance.

The connection from a storage tank to the printing device of a further embodiment of the formulation unit is adapted to supply ink continuously from the storage tank to the printing device during the printing process. This means that in operation of the printing device the storage tank of the formulation unit is constantly connected to the printing device.

In a further embodiment, the preparation device is adapted to prepare ink which is supplied to the storage tank while ink is supplied from the storage tank to the printing device in particular according to the demand of the printing device. In this way, the supply from and to the storage tank can take place concurrently and independently. This also involves the possibility to establish a partially or wholly automated process where ink is prepared in the preparation device for example according to the filling level of the storage tank and/or according to the demand of the printing device.

In an embodiment of the formulation unit, the preparation device comprises a preparation tank. For preparing ink, all ingredients of the ink to be prepared have to be filled into the preparation device, in particularly into the preparation tank. A development of the preparation device comprises a circulation tube in particular connected to the preparation tank in the manner of a loop for establishing a circle through which can be circulated the ingredients of the ink to be prepared. This enables a smooth mixing procedure whereby an absorption of air into the ink can be prevented to a large extent.

For circulating the ingredients and the ink, respectively, the preparation device comprises a preparation pump or a preparation turbine. The use of a pump or a turbine for preparing the ink depends on various parameters as for example the volume and rate of the ink to be circulated, the viscosity and resolution status of the ingredients used, the disposition of the mixture to absorb air or cleaning requirements. A preparation turbine for example drives the mixture in high speed through the circulation tube for mixing the solution. A preparation turbine further may have small dimensions and a low noise level.

In more elementary embodiments of the formulation unit, the ingredients of the ink have to be filled manually into the preparation unit, for example a dye in form of powder or in form of a colour-concentrate, which are difficult to handle and to dose, from a prepared package, or a certain volume of the necessary additive chemicals or of deionised water. The amount of additive chemicals and deionised water is for example defined by the package size of a dye-powder. In a more enhanced embodiment for example a dye-powder is still filled in manually, wherein the deionised water and the additive chemicals are added by means of known automated metering equipment. The same applies if a colour-concentrate is used for preparing the ink, which already contains the necessary additive chemicals and only deionised water needs to be added. Subsequently dye-powder, dye-fluid or colour-concentrate are referred to as "dye" irrespective of whether or not all necessary chemicals are already contained in the dye. Where appropriate, a distinction will be made.

A further embodiment of the formulation unit comprises a dosing device for automatically dosing at least one ingredient of the ink, in particular the dye. Apart from loss of dye in small packages, this avoids dusting of powder dyes and with liquid dyes this avoids sprinkling and spill and additionally and more important the incorporation of air while filling the dye into the preparation device. In addition to an automated metering equipment for deionised water and for possible further ingredients, a dosing device for automatically dosing the dye enables a wholly automated process for preparing ink in the formulation unit, in particular also on demand. A dosing device for automatically dosing the dye enables also the preparation of different volumes of ink, for example for preparing a smaller amount of a sparsely used ink in a printing procedure.

In one embodiment the formulation unit comprises at least one dye dosing device which is connected to a dye container tank containing dye for several ink preparing processes. The dye dosing device is manually operated or controlled by a control device and serves to meter the amount of dye according to the amount of ink to be prepared.

In one embodiment the formulation unit comprises a dye dosing device which is designed to receive a dye package and to empty the content of the package into the preparation tank or a feed line thereto. In this case, a package contains a certain amount of dye for preparing a predetermined amount of ink in the preparation device. The package and the dosing device are designed such that the dosing device is capable to empty the content of the package without significant dusting of powder dyes and without significant sprinkling and spill with liquid dyes. Additionally the package and the dosing device are designed such that the incorporation of air while emptying the package is substantially avoided.

A preferred suitable dye package design is a container for example in form of a capsule, a casing, a cartridge, a soft pack, a blister, a can or the like. Preferably, a dye release opening is arranged at a first end of the dye package. A suitable dye package design comprises in particular at least one predetermined breaking point like a, particularly perforated, seal for emptying the dye package. Preferably, the seal comprises a sealing section, which is connectable to a wall section of the dye package adjacent to the dye release opening. Preferably, the sealing section may be separated at least in sections from the dye package by a band or strap which extends from the sealing section. Preferably, the seal may be broken at least in sections by means of a band or strap which extends from a sealing section of the seal. Alternatively, the dye release opening may be closed by a releasable lid. Preferably, a package gasket is arranged adjacent to the dye release opening.

One preferred embodiment of the dye package comprises a collapsible or foldable section, preferably a harmonica type wall section, which permits to reduce the package volume while emptying the dye package (collapsible package). Preferably, the collapsible package may be transferred from a first state into a collapsed state while releasing the dye. Preferably, the collapsible package comprises an essentially planar wall section or package bottom on which a stamp of the dye dosing device may act to transfer the dye package into its collapsed state. Preferably, in the first state, a cross section, which is arranged essentially perpendicular to the dye release opening, of the collapsible package is essentially trapezoid with its longest border facing the dye release opening. This embodiment may offer the advantage of an improved release of the dye. Several of the collapsible package may be stacked by an operator in the dye dosing device and may conveniently be unstacked by the formulation unit.

An alternative dye package comprises a longitudinal axis and an essentially circular first end and/or an essentially circular dye release opening. Preferably, the essentially circular first end and/or the essentially circular dye release opening is arranged essentially perpendicular to the longitudinal axis. The alternative dye package comprises an essentially circular cross section or essentially hexagonal cross section arranged essentially perpendicular to the longitudinal axis. Preferably, the dye package comprises a package thread and/or a locking projection arranged adjacent to the dye release opening. Preferably, the dye package has a movable disk or piston which may be moved essentially parallel to the longitudinal axis towards the dye release opening to support the release of the dye. This alternative may offer the advantage of an improved release of the dye. By the hexagonal cross section, a higher torque about its longitudinal axis may be applied to the dye package while connecting it to the formulation unit or one of its dye dosing devices.

The dye packages may have different sizes according to the amount of ink to be prepared. It is also possible that for the preparation of a small amount of ink the content of one dye package is required and for the preparation of a medium or larger amount of ink the content of two or more dye packages is required. It is also possible that for the preparation of a special ink, packages containing different colour dyes or dyes with different characteristics are employed. As there is the possibility to vary the dye which is comprised in the packages, it is possible to prepare customised ink in respect to colour or other properties. It is also possible to use the dosing device for adding further ingredients to the preparation tank which are contained in corresponding packages. In addition, the use of dye packages simplifies the supply of ingredients for ink preparation from dye manufactures to the ink processing plants.

In one embodiment the packages for the preparation of ink comprise security labels containing data according to the content of the package. A label reader at the dosing device reads out the data and thus guarantees that the requested ink will be prepared. The application of security labels enables to ensure the use of proper ingredients of known origin having the required quality for the preparation of ink within the formulation unit.

In one further embodiment the dye packages are made up of recyclable materials for providing a further use of the materials. Similarly is also possible that the dye packages are made up of already recycled materials. In this way a recirculation system of dye packages is possible. In a further embodiment the dye packages may have a refillable design which facilitates the reuse of refilled dye packages and also allows for a recirculation system the dye packages.

In one embodiment the formulation unit comprises at least one ink filter for filtering the prepared ink. Preferably, one or more of the preparation devices each comprise one of these ink filters. Preferably, the at least one ink filter is arranged downstream of a circulation pump or within a circulation tube, the circulation pump or the circulation tube being part of at least one of the preparation devices. This at least one ink filter may serve to reduce down times of the formulation unit and/or the frequency of cleaning or rinsing of at least on of the tubes which guide the ink.

A further embodiment of the formulation unit comprises a degassing device which is arranged between the preparation device and the storage tank and wherein the storage tank is a buffer vacuum container which is connected directly to the ink inlet of the printing device.

In one embodiment a degassing device is arranged downstream of each preparation device. An exemplary suitable degassing device comprises a degassing component which is connected to a vacuum pump and which is arranged in the feed line from the preparing device to the storage tank. The prepared ink is passed through the degassing component at a certain flow rate of for example 0.5 liters per minute and degassed during its flow through the degassing component where it is subjected to below atmospheric pressure of for example 0.9 bar. By flowing through the degassing component almost all gaseous parts in the prepared ink are removed. After the degassing process the ink is fed into the storage tank.

As air incorporated within the ink leads to malfunction of the printing device and to misprints, degassing of the ink improves the quality of the ink and the printing result visibly. For not to allow air or gas to incorporate again into the ink after the degassing in the degassing device, in particular the ink is directly supplied to a storage tank which is a buffer vacuum container and therefore does not contain gas or air that could incorporate into the ink. The outlet of the buffer vacuum container is connected directly to the ink inlet of the printing device. This tubing is also free from gas or air that the ink can be jetted with high quality onto a substrate.

In a further embodiment of the formulation unit, the dye dosing device comprises a package connector for accepting a section of one of the dye packages, a cutter for opening the dye package and a sprinkler for directing a liquid towards the dye package.

The package connector comprises an opening through which the dye may be fed to the preparation tank of feed line. Preferably, the package connector comprises a socket for accepting a wall section of the dye package and the dye release opening and preferably a socket gasket. Preferably, the socket comprises a socket thread for accepting the package thread or the locking projection. Preferably, the socket comprises a locking element to releasably engage with the locking projection of the dye package (locked state). Preferably, the socket comprises the opening through which the dye may be fed to the preparation tank or feed line.

The cutter is provided to cut a wall section or a seal of the dye container. Preferably, the cutter is provided with a blade and arranged to move the blade to follow a circular arc or path to cut a wall section or seal of the dye package which is accepted by the package connector or its socket. Preferably, the blade is arranged adjacent to the socket. Preferably, the blade may follow the circular path covering an angle between 180° and 345°, particularly preferred between 225° and 315°, particularly preferred approx. 280°. Preferably, the blade is arranged at an angle to the plane of the circular arc. Preferably, there is a second blade arranged adjacent to a second end of the dye package opposite of the dye release opening serving to open the second end which may improve the release of the dye. By limiting the circular path the seal is not detached from the dye container and can not interfere with the subsequent preparation of the dye.

Preferably, the sprinkler is provided also to direct the liquid into the dye package or towards the seal to improve the release of the dye. Preferably, the sprinkler is provided to direct the liquid also towards the preparation tank or feed line which may improve the transport of the dye. Preferably, the sprinkler is arranged adjacent to the socket which may help to clean the wall section or the seal to be cut by the cutter. Alternatively, the sprinkler is arranged adjacent to the second end of the dye package to direct liquid into the dye package which may improve the release of the dye. Preferably, a second sprinkler is arranged adjacent to the second end directing liquid into the dye package which may improve the release of the dye.

This further embodiment of the formulation unit may improve the release of the dye.

A preferred method to operate this further embodiment of the formulation unit comprises the steps:

j) introducing one of the dye packages into the package connector, preferably into the socket, preferably introducing the locking projection of the dye package into the socket thread, preferably rotating the dye package about its longitudinal axis into the locked state, k) opening the dye package, particularly cutting the seal of the dye package within the socket and/or the second end of the dye package, with the cutter, particularly moving a blade of the cutter along the circular arc or path covering an angle between 180° and 345°, l) directing the liquid towards the seal or into the dye package with the sprinkler for improved release of the dye from the dye package, preferably with at least one of the steps m) directing the liquid towards the seal with the sprinkler to remove dirt from the outside of the seal, preferably before step k), and/or n) directing the liquid also towards the preparation tank or feed line with the sprinkler to promote the transport of the dye, preferably during step l), and/or o) discharging liquid from the formulation unit or from the dye dosing device to dispose of dirt from the outside of seal, preferably before step k), preferably after or during step m), and/or p) removing the dye package from the package connector, preferably after releasing the locking projection, preferably after emptying the dye package, and/or, q) destacking one of these dye packages from a stack of dye packages by the dye dosing device, preferably before step j).

This method may improve the release of the dye and may help to avoid contaminating the dye with dirt from the seal.

According to a second aspect of the invention, the problem is solved by an inkjet printing machine with a formulation unit and a printing unit. The printing unit comprises a printing device for jetting ink onto a substrate, an ink supply device for supplying ink to the printing device and a substrate supply device for supplying the substrate to the printing device.

The formulation unit of the inkjet printing machine is designed as described before. In one embodiment of the machine the size of the formulation unit is small as also is the amount of ink which is prepared in one preparing process. By contrast, ink distribution canisters and also storage tanks of known inkjet printing machines contain usually several liters of ink for longer printing periods which means long residence and storage times particularly for ink with small output quantities. The formulation unit of the inkjet printing machine according to the invention allows frequently preparing and storing smaller volumes of ink according to the demand of the printing process and printing device respectively. In this way a simple, reliable and thus economical installation with very easy maintenance is provided.

In an arrangement in which the inkjet printing system comprises a formulation unit it is possible to prepare ink corresponding to the ongoing printing process. In a more simple approach, the formulation unit is triggered to prepare an ink as soon as the filling level of an ink storage tank declines or drops below a predetermined level. In a more elaborate approach, the control device of an inkjet printing machine triggers the preparation of ink according to the ink consumption in the further printing process.

Furthermore the small size of the formulation unit enables flexibility in terms of spatial arrangement of the formulation unit with regard to the printing unit. Moreover it is possible to prepare ink for more than one inkjet printing machine by means of one moveable formulation unit which can be connected consecutively or concurrently to the storage tanks of multiple inkjet printing machines.

The substrate on which the printing device of the printing machine jets ink is preferably a textile. However, it is also possible to use the invention for inkjet printing machines for other substrates like paper or films, foils, laminates or any other substrate suitable for inkjet printing.

According to a third aspect of the invention, the problem is solved by a method for preparing an ink using a formulation unit in particular as described above. The method depends on the kind of the dye used.

In a first embodiment the method comprises the steps:

a) fill the preparation tank with a first amount of deionised water;

bc) add a predetermined amount of dye or colour d) mix the ingredients filled into the preparation tank;

e) add a second amount of deionised water;

f) mix the ingredients filled into the preparation tank.

The method is especially suitable for being performed by using the above described formulation unit, and in particular with an inkjet printing machine as described above. However it is also possible to use any other suitable formulation unit.

In a first step (a) the tank is filled with a first amount of deionised water. A preferred amount for the first filling is about one third of the final volume of water. Deionised water is required for maintaining the purity of the product at a maximum level.

In a second step (bc) a certain amount of a dye or colour according to the volume of the prepared ink is put into the tank.

The dye can be used in solid form, e.g. in form of a powder, in granulated form, in supergranulated form or in form of cold dissolving granules (CDG), or in form of a colour-concentrate.

In one embodiment, the colour-concentrate is heated up to 30° C., preferably up to 50° C., preferably up to 55° C., preferably up to 70° C. prior to being mixed with deionised water. The advantage of using the dye in form of a colour-concentrate is that dust formation can be reduced, preferably prevented.

If a formulation unit according to the invention is used, it is also possible so use the dye in solid form, without risking that the environment (e.g. the worker filling the formulation unit with the dye) is exposed to dye dust. A further advantage of the use of dye in solid form is that it is easier to determine the amount of further chemicals needed to form the ink, since the starting point for such a calculation is regularly the amount of dye present in the ink.

In a third step (d) the ingredients within the tank are mixed in a way that the dye or colour is distributed homogenously (e.g. is dissolved or dispersed completely) in the fluid and possibly no air is introduced into the fluid.

In a fourth step (e) a second amount of deionised water (a preferred amount is two third of the final volume) is added to the tank and in a fifth step (f) the ingredients within the tank are again mixed to distribute (e.g. to dissolve or disperse) the ingredients homogenously and in a way to avoid the introduction of air into the fluid. In a further embodiment the ingredients and the formulation unit are adapted such that the whole process takes less than 10 minutes which means high flexibility and low logistic costs as the lead time for the preparation of ink is very short.

In a second embodiment the method comprises the steps:

a) fill the preparation tank with a first amount of deionised water;

b) add a predetermined amount of additive chemicals;

c) add a predetermined amount of dye;

d) mix the ingredients filled into the preparation tank;

e) add a second amount of deionised water;

f) mix the ingredients filled into the preparation tank.

The second embodiment differs from the first embodiment of the method in an additional step b) wherein additive chemicals are added to the water in the tank. Those chemicals can e.g. serve for enhancing the dissolution of the colour concentrate (for example Hostapal or DEG), or for stabilizing a dye dispersion in case e.g. water-insoluble dyes are used.

In contrast to the first embodiment, in step c) a dye is added, which does not have to contain any other chemicals than colour ingredients, as additive chemicals are filled separately into the preparation tank.

The term "ink" as used herein according to the invention means a composition comprising at least a dye. Further components that may be present within the ink are water, preferably deionised water; and/or additive chemicals. Compounds which can be used as suitable additive chemicals for an ink can be selected from the group: ink stabilizing compounds; anti-fungi chemicals; diluents, dispersing agents, solubilizing agents or a mixture of one or more of these compounds. The term "ink" is used after the composition comprising at least one dye has left the formulation unit. The ink can be designed as solution, i.e. in essence all components are present in the ink in dissolved state or as dispersion, i.e. at least one component, in particular the dye, is present in the solid state, but distributed homogenously within the fluid.

The term "dye" as used herein according to the invention, means a substance which is capable of being used as a component of an ink, in particular as colour. The dye can be used in any form suitable to be mixed with further components in order to form an ink for inkjet printing machines. In one embodiment, the dye is used in a solid form, preferably in powder form. In another embodiment, the dye is used in a liquid form or viscous form, preferably in form of a colour-concentrate. The term "dye" is used prior to and during the presence of the composition within the formulation unit.

In one embodiment, the dye used is in powder form only consisting of pure dye or colour powder, e.g. reactive dyes, like Reactive Red, Reactive Yellow, Reactive Blue, Reactive Turquoise, Reactive Red, Reactive Black, or Reactive Orange. If the dye is used in powder form only consisting of pure dye-colour powder, deionised water and further additive chemicals can be added in order to obtain an ink. Preferably, at least a diluent is added to the pure dye powder.

Generally every diluent suitable to be used in an ink and known by the skilled person can be used. Such a diluent preferably comprises at least one compound selected from the group of glycol, wetting agents, dispersing agents or solubilizers.

In one embodiment, the diluent is provided in step b) of the above described second embodiment of the method according to the invention.

In one embodiment, the dye used has a tar-like viscosity and is preferably used in the form of a colour-concentrate. In this embodiment, the dye comprises the dye powder suspended in at least one additive chemical, preferably in a diluent as defined above. The advantage is, that now only water, in particular deionised water can be added in order to obtain an ink.

FIGURES

Further advantages, features and possible applications of the present invention ensue from the following description in conjunction with the figures.

Figure 2:
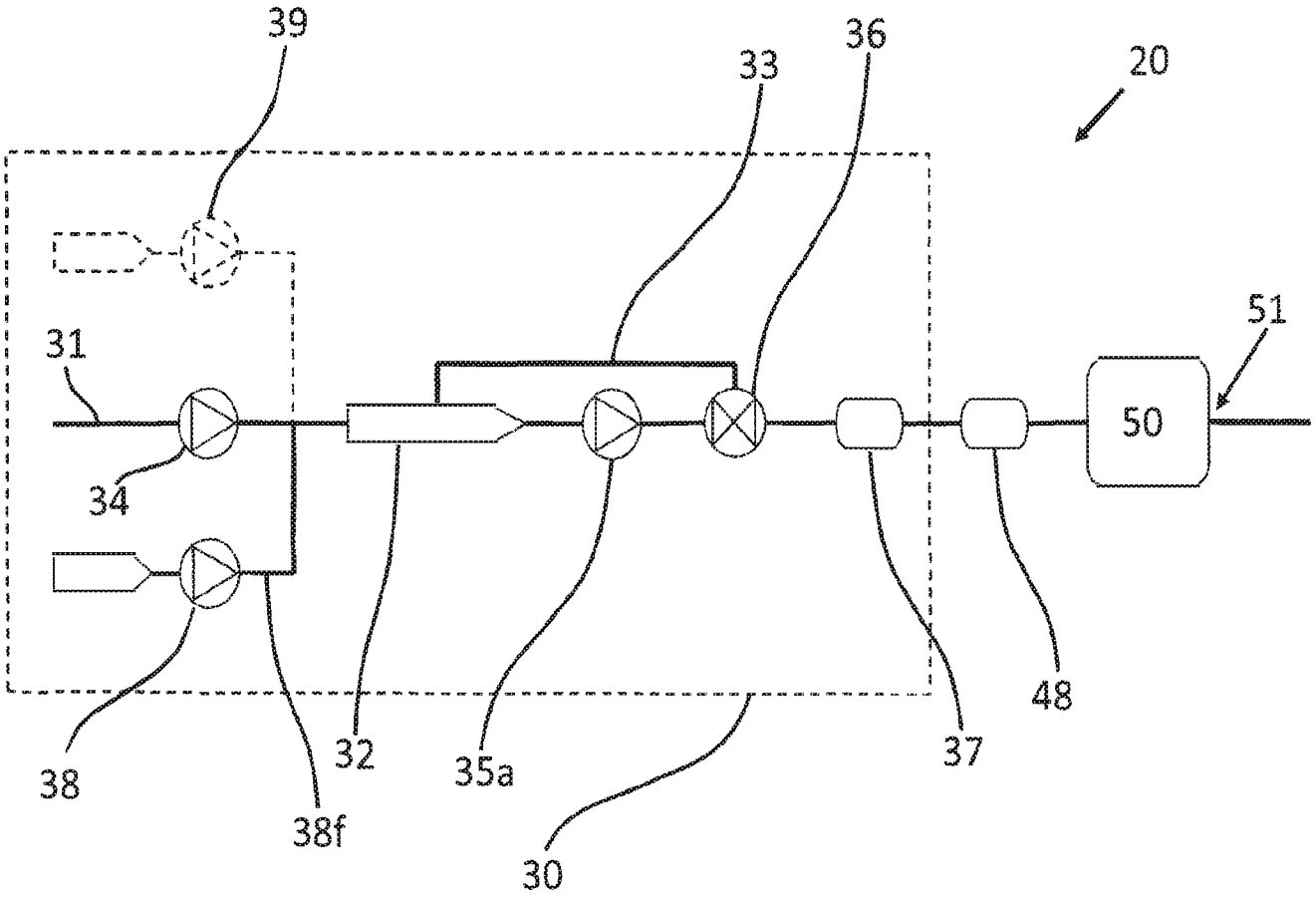
Figure 3:
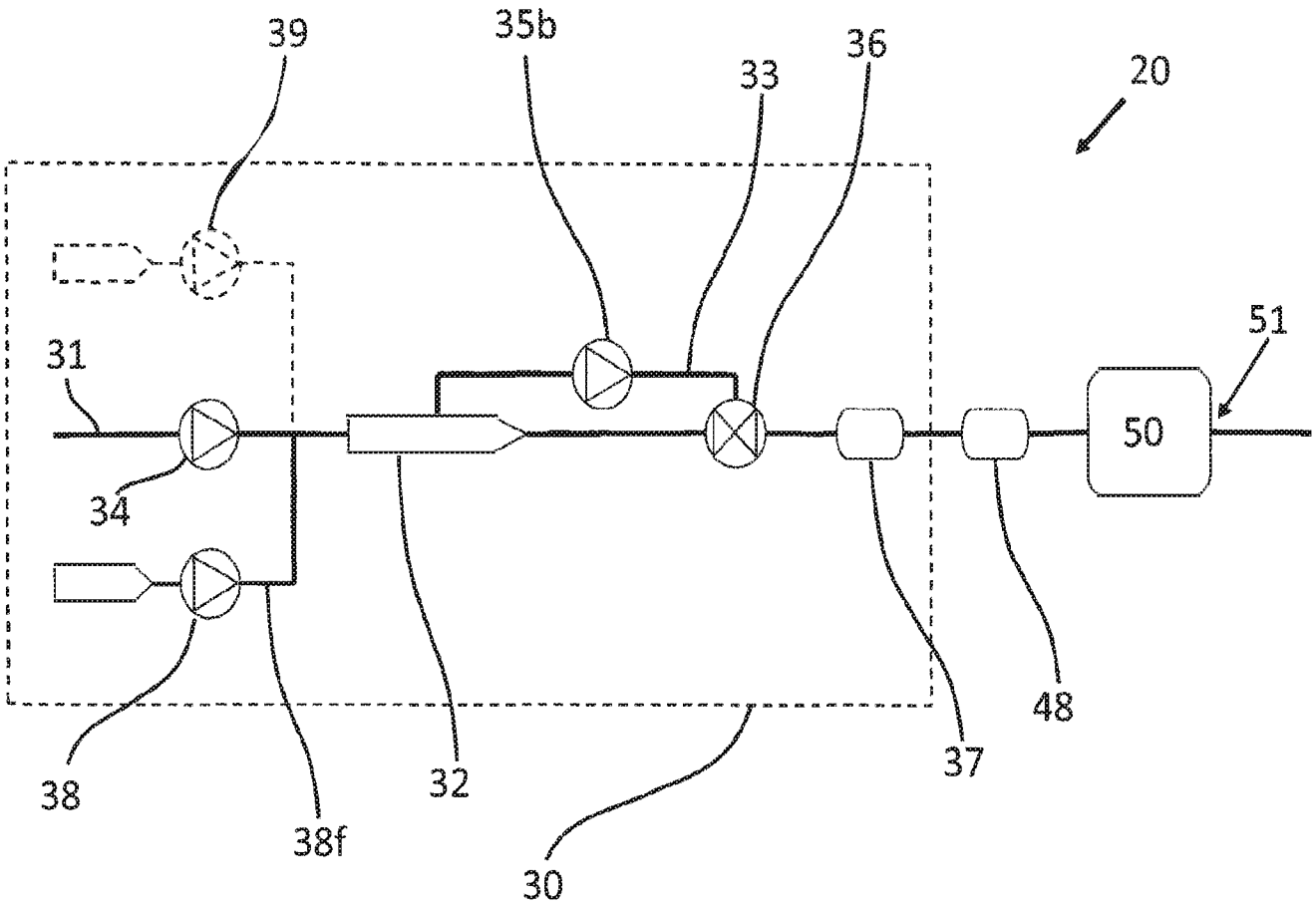
Figure 4:
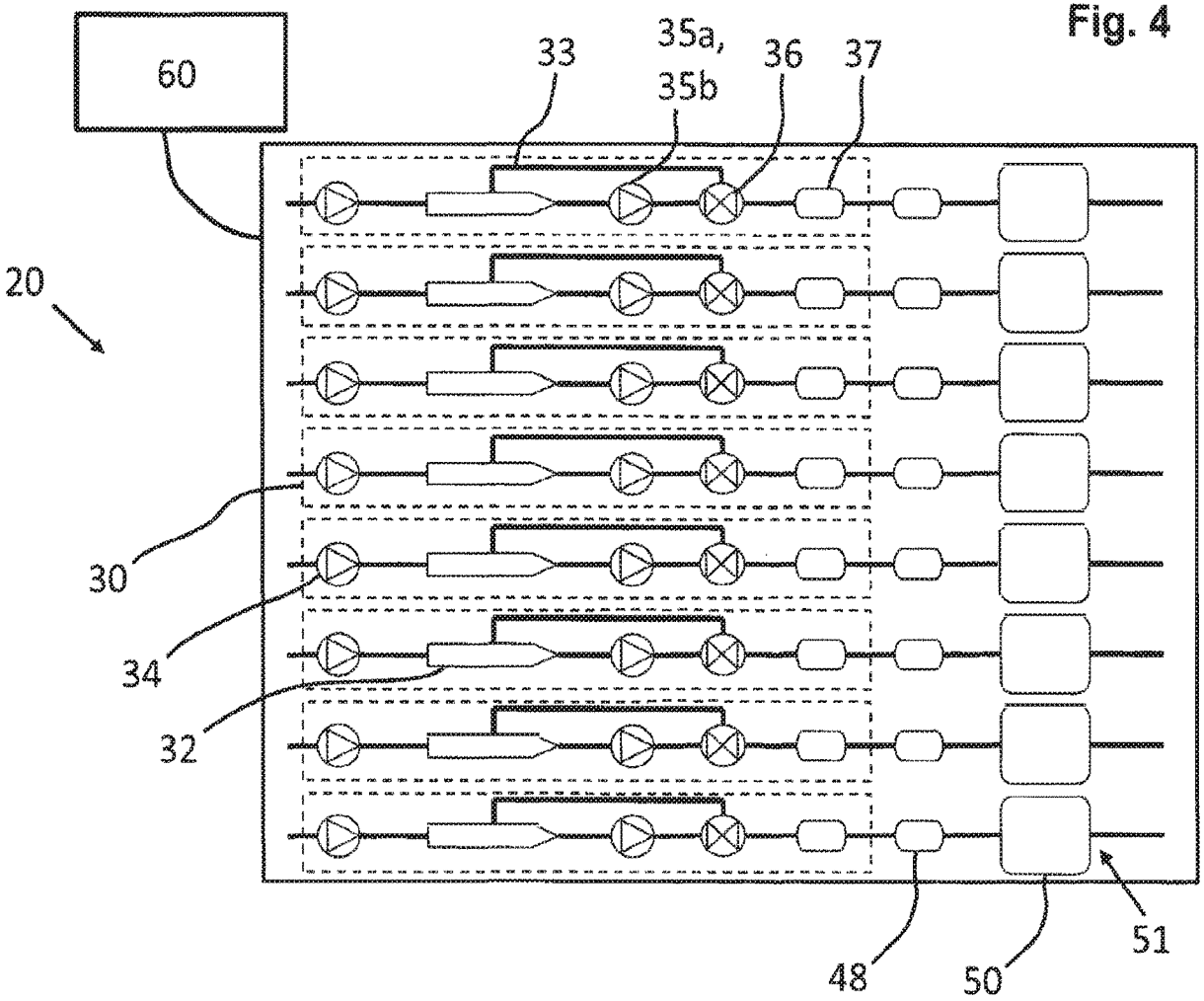
Figure 5:
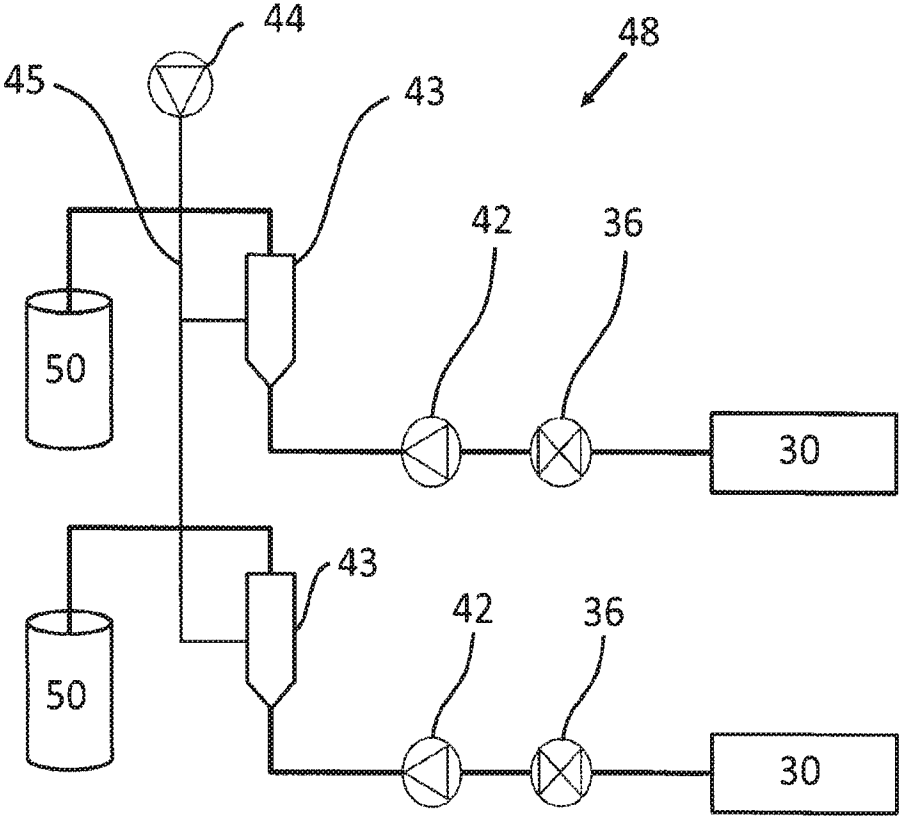
Figure 6B:
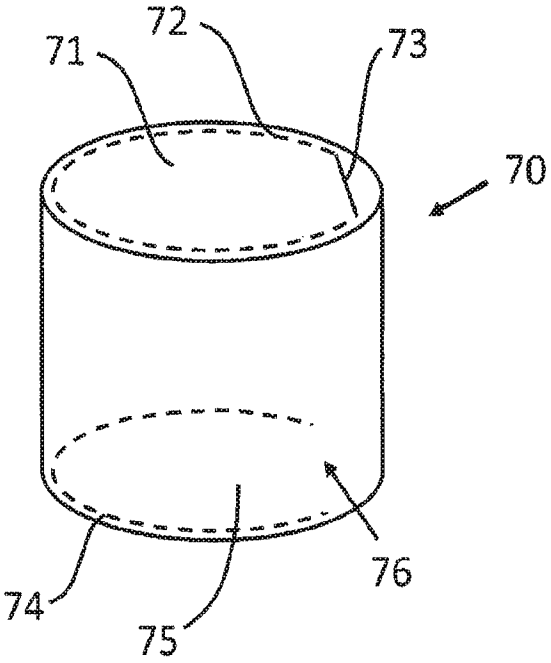
Figure 6A:
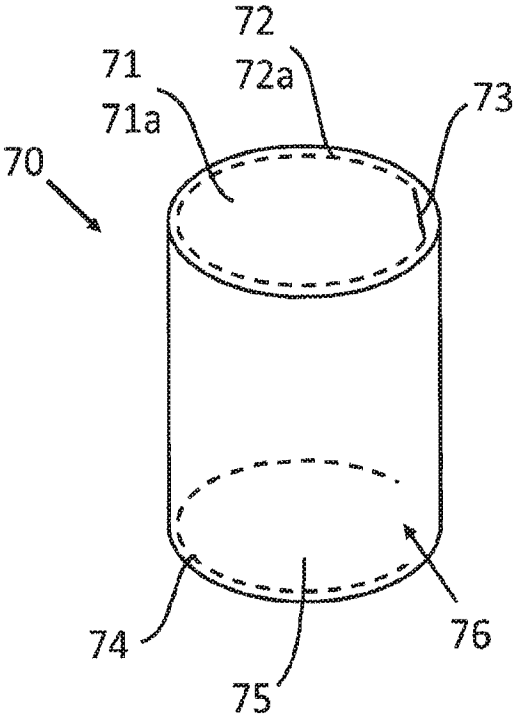
Figure 7:
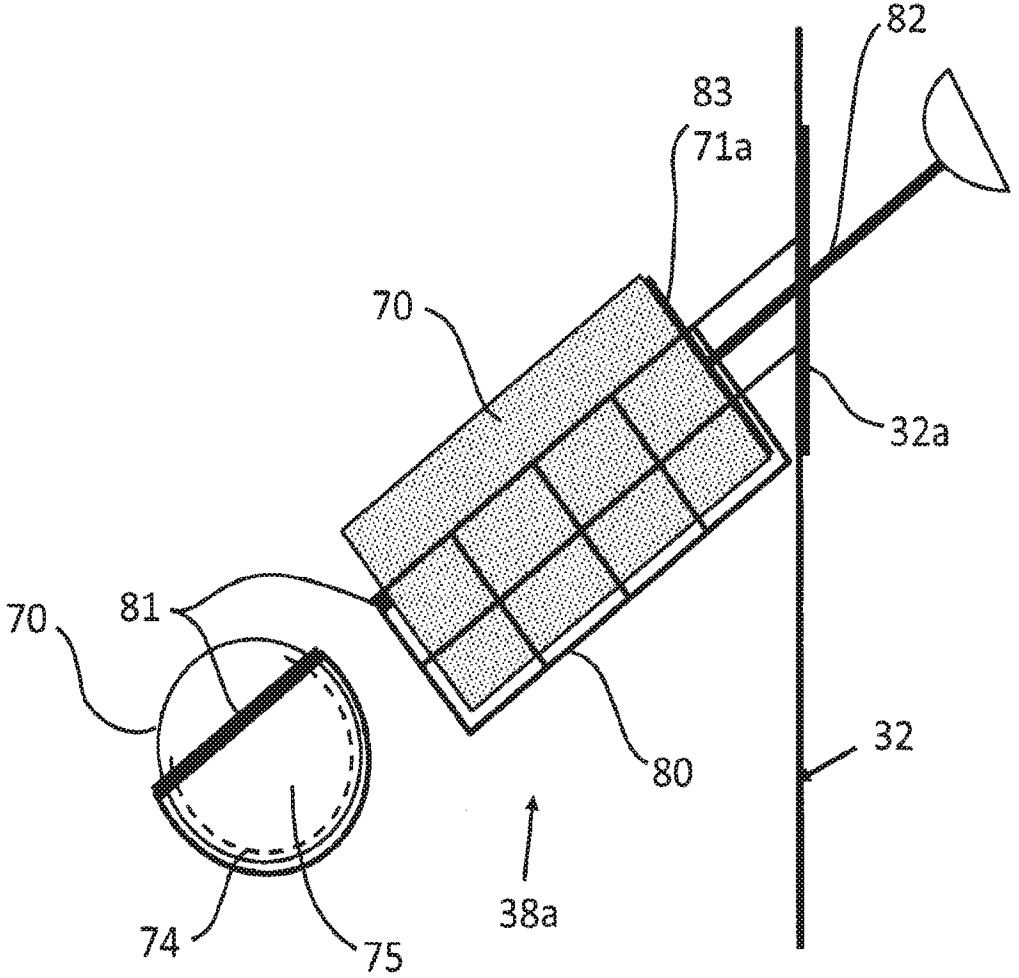
Figure 8:
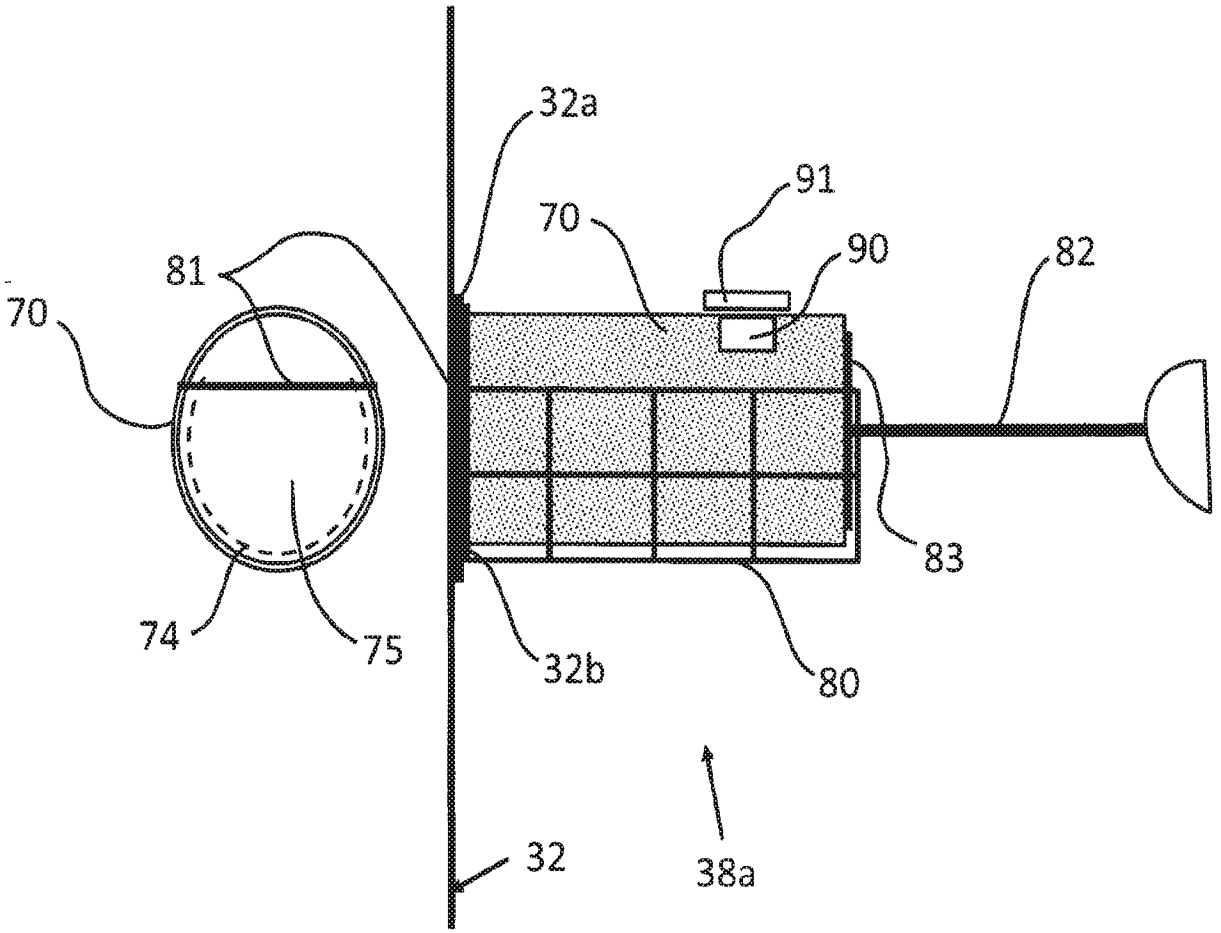
Figure 9:
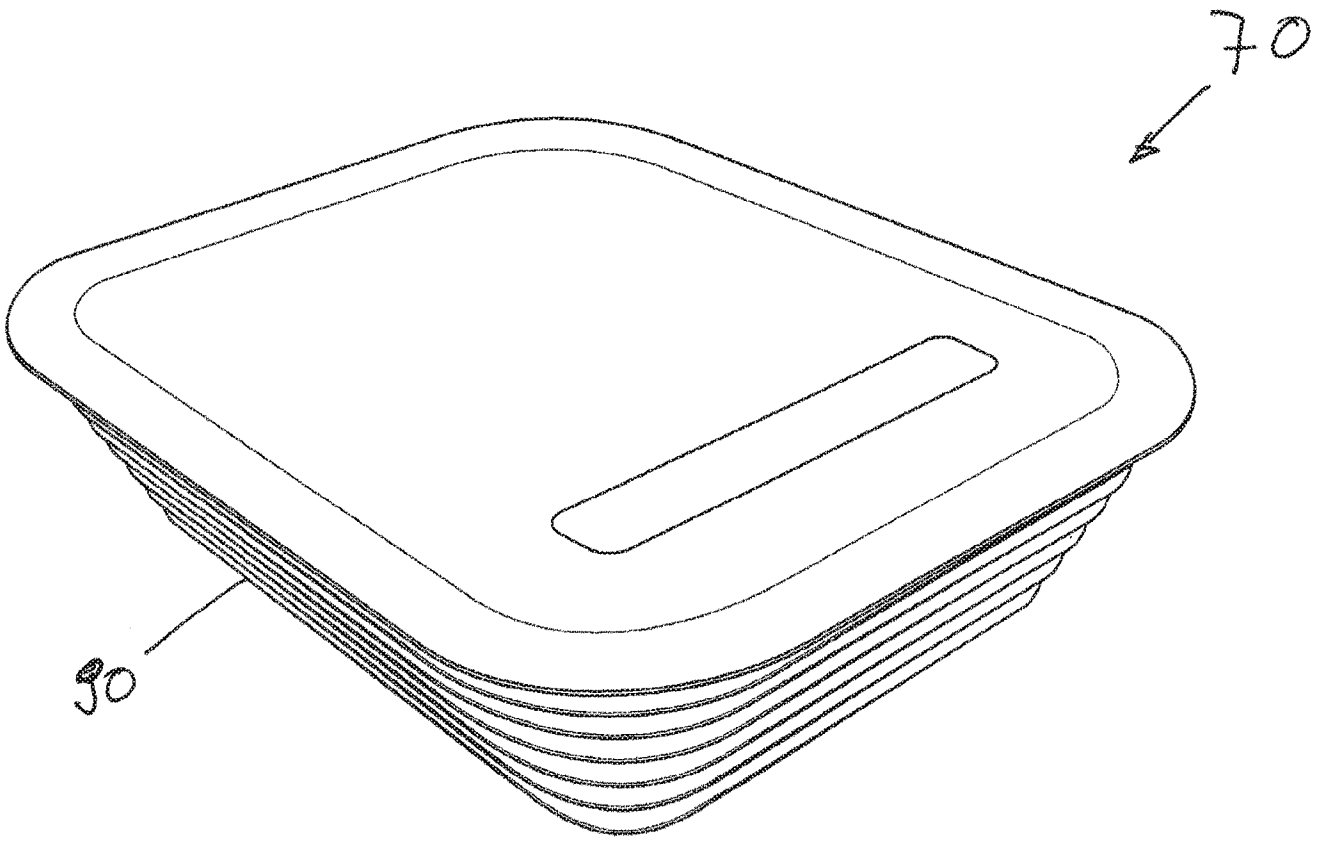
Figure 10:
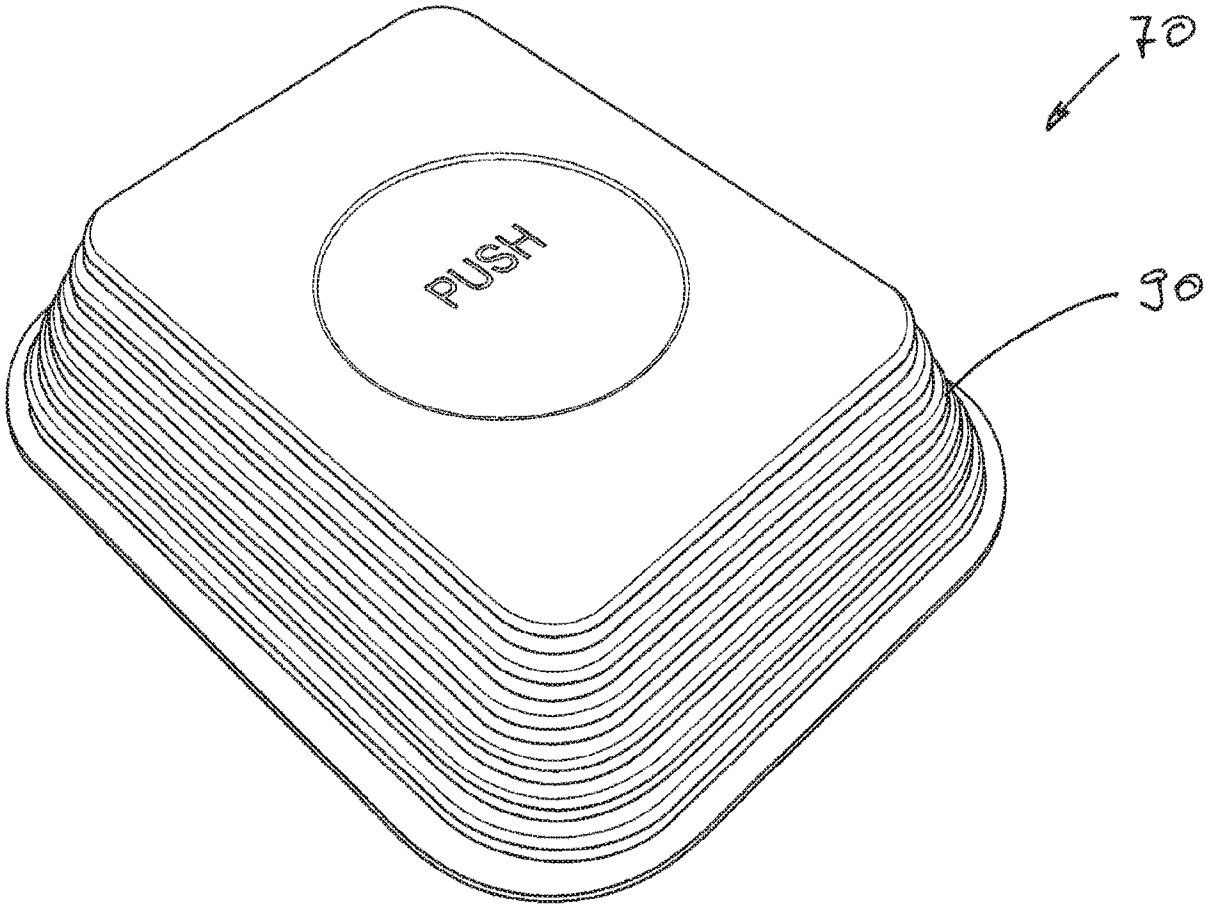
Figure 11:
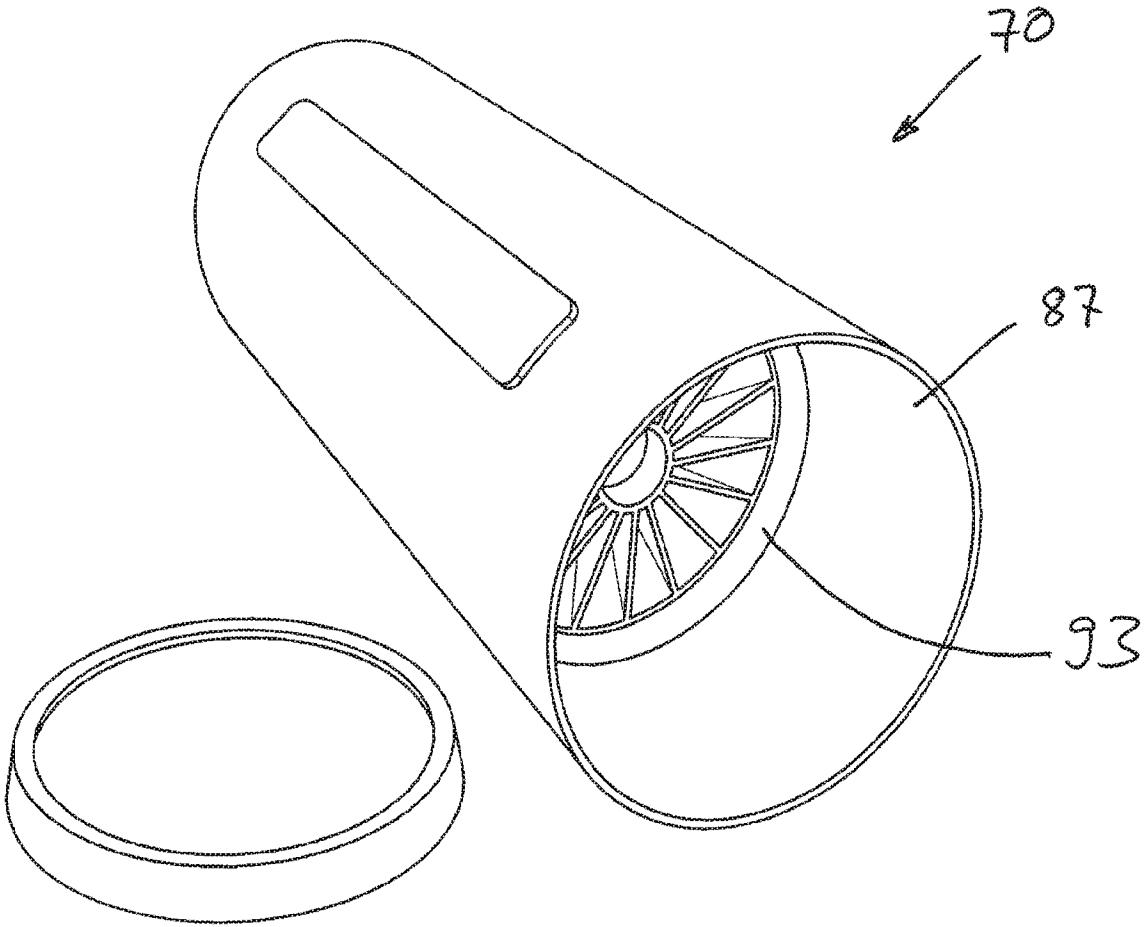
Figure 12:
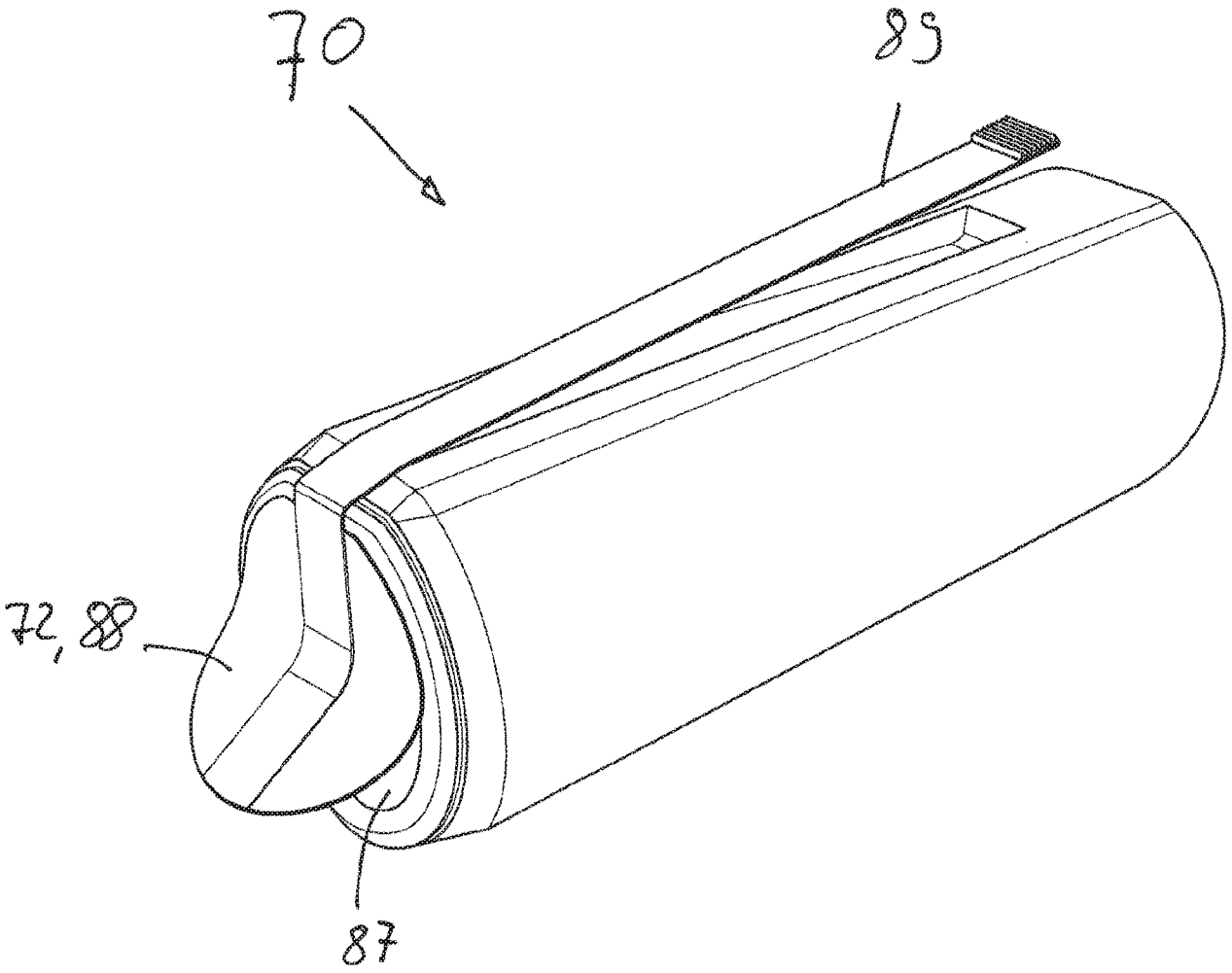
Figure 13:
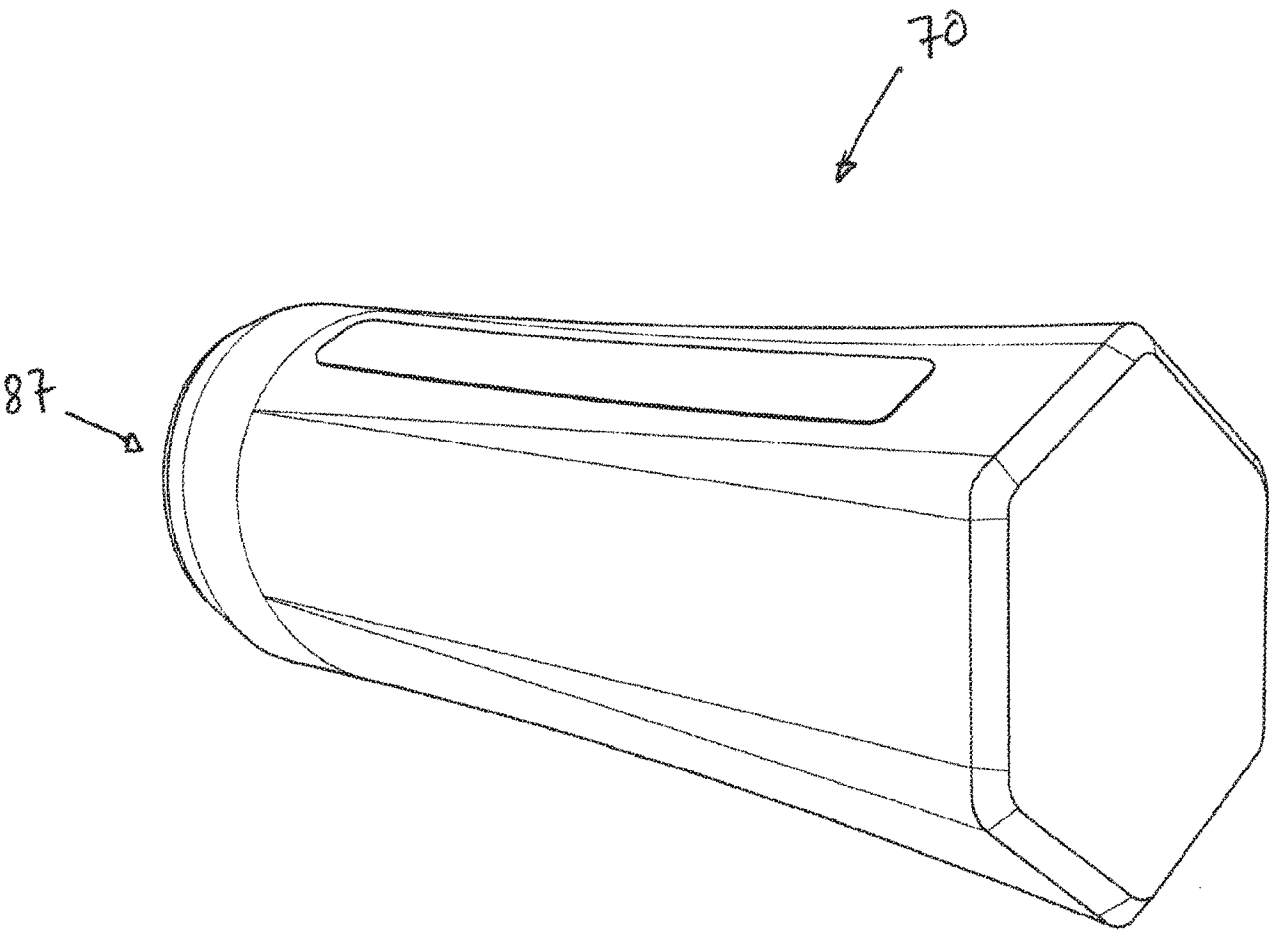
Figure 14:
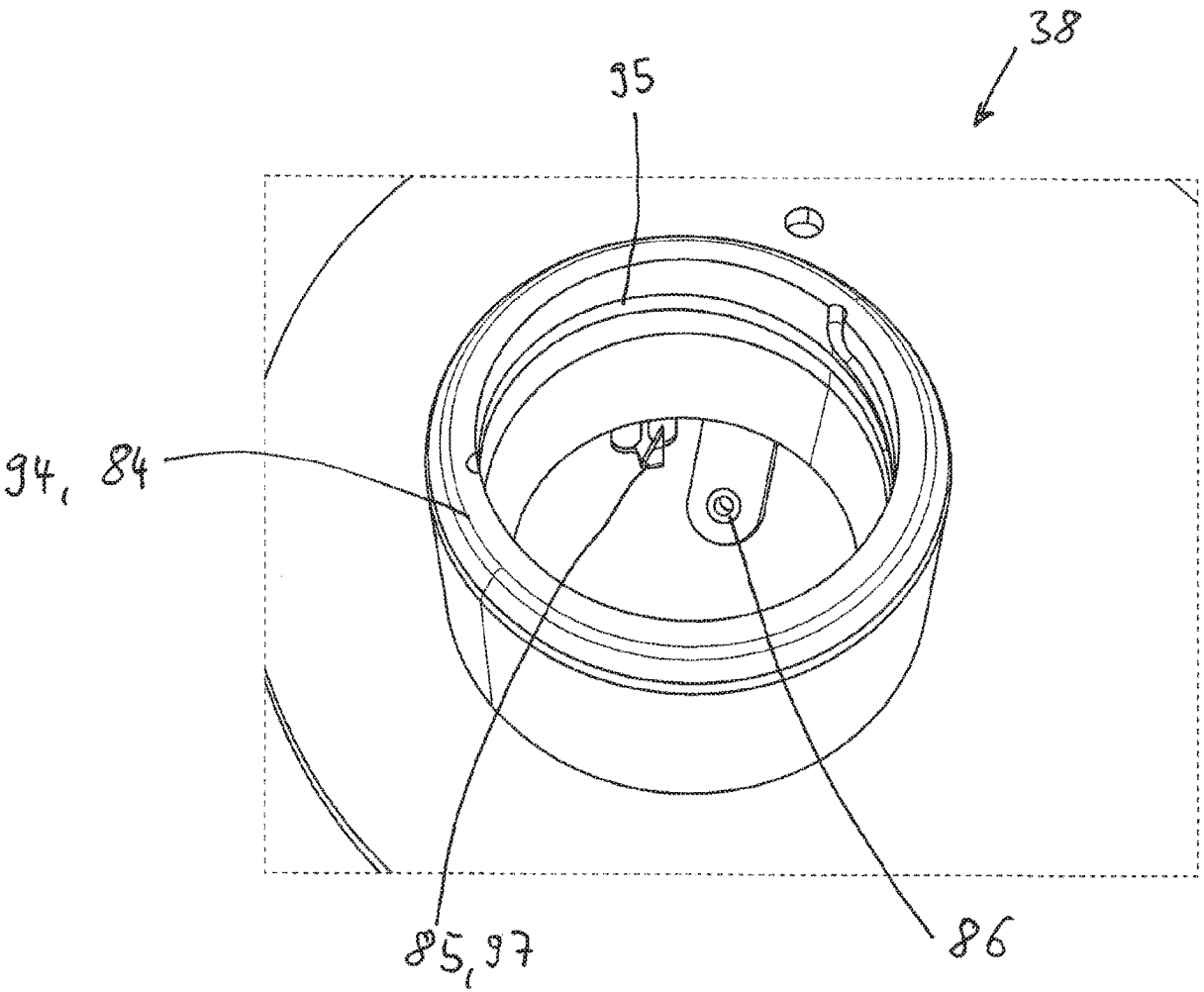
Figure 15:
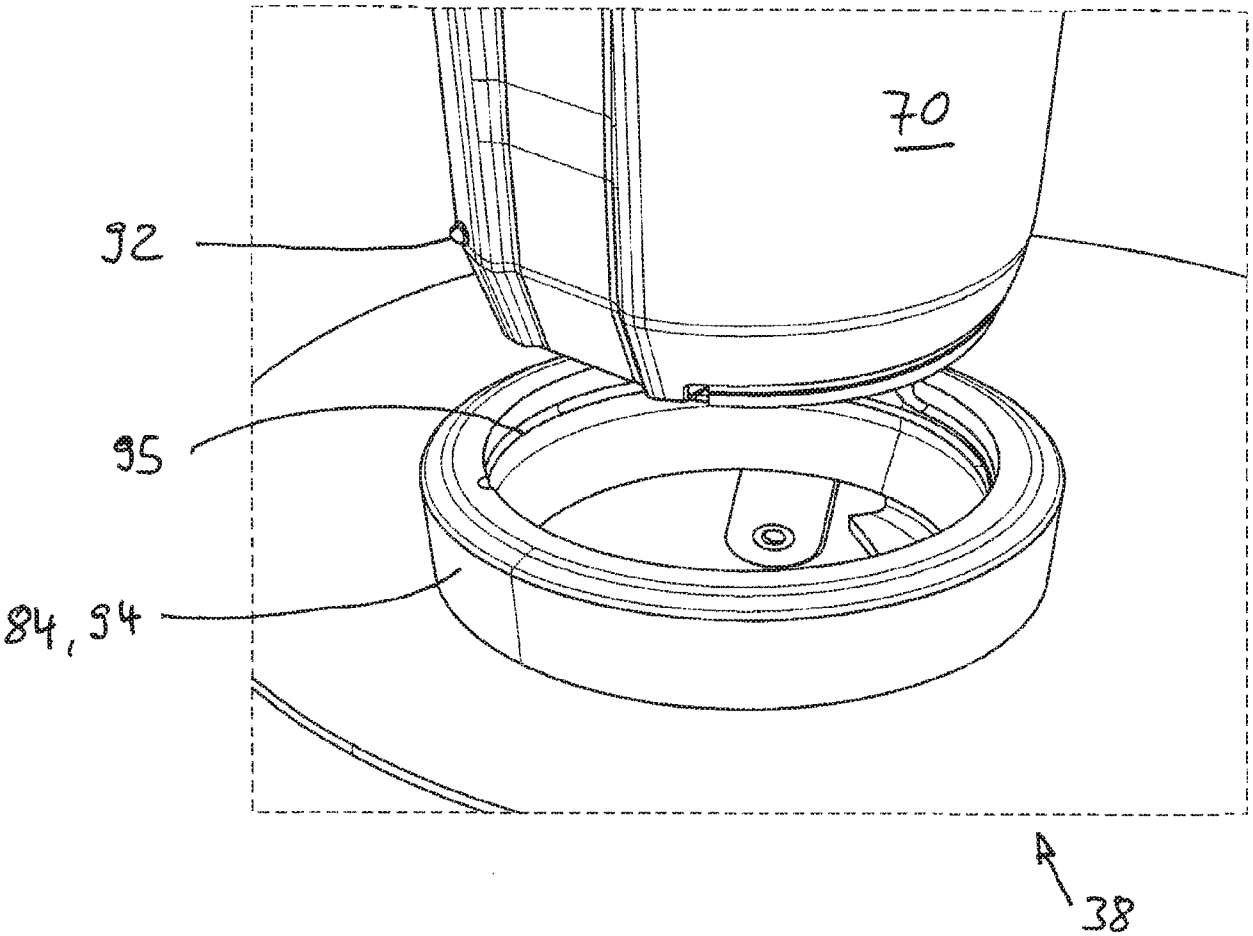
Figure 16:
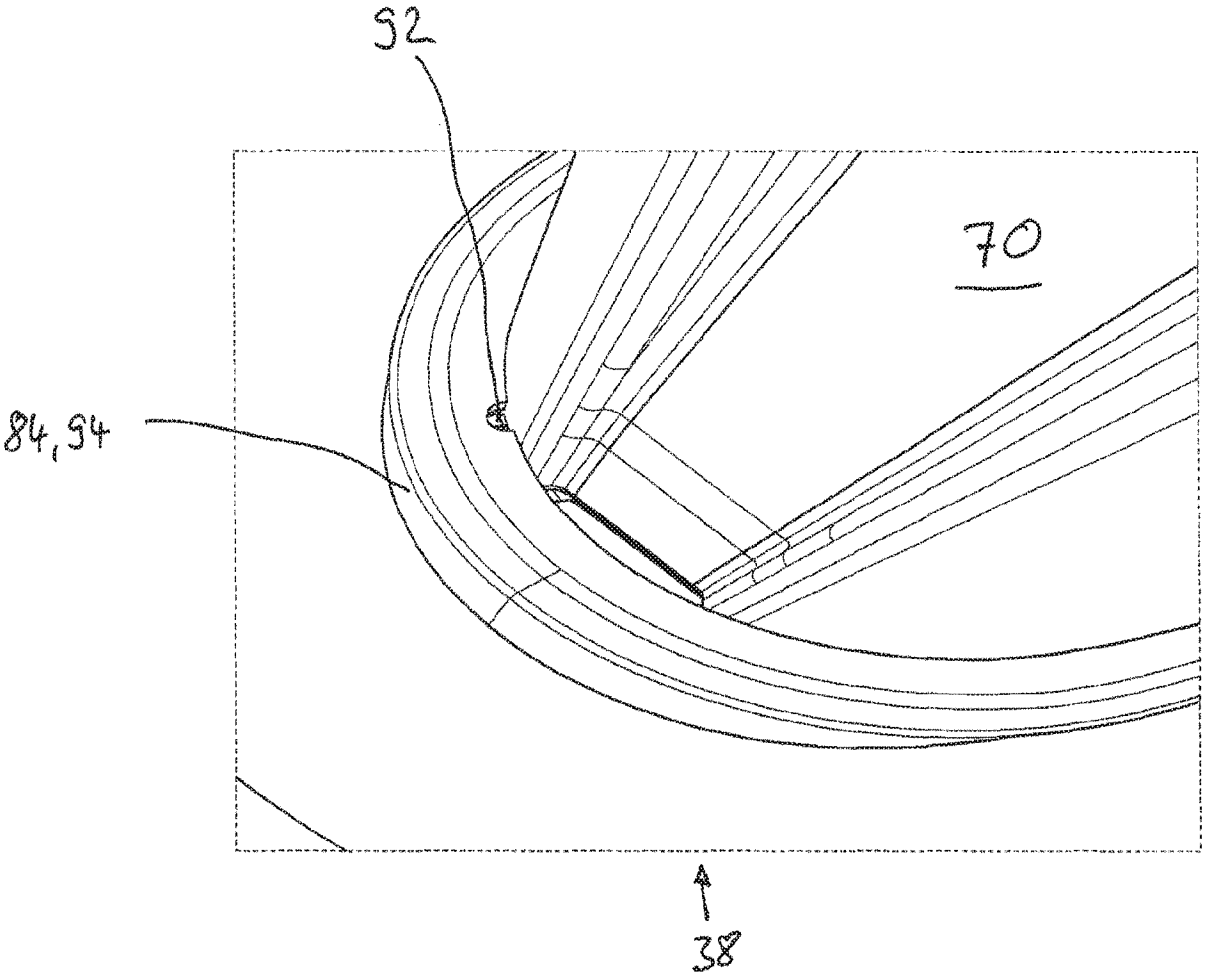
Figure 17:
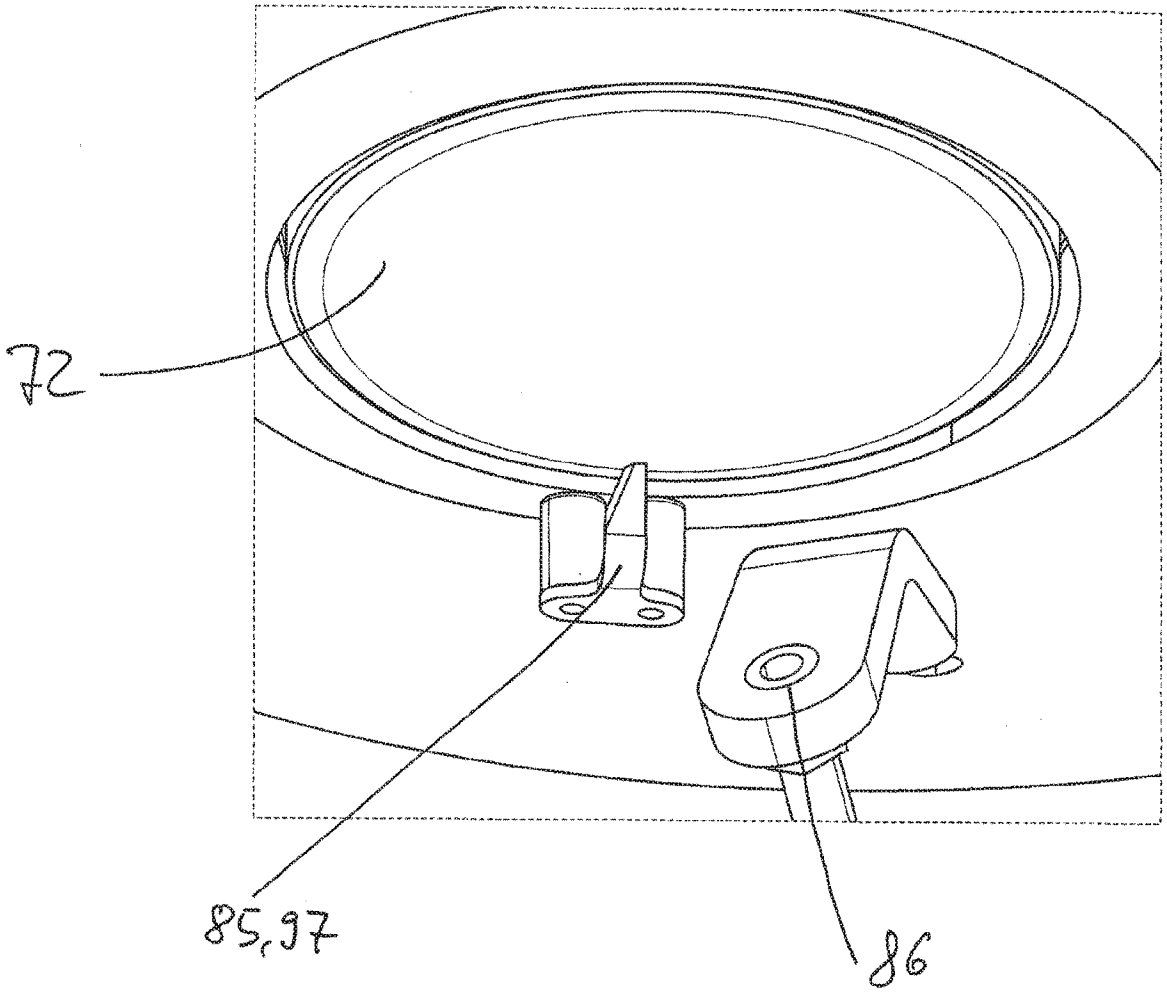
Figure 18:
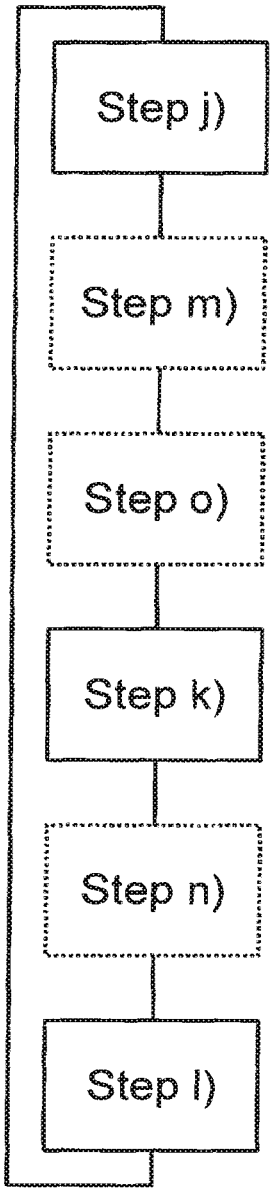

FIG. 1 shows a schematic view of an exemplary inkjet printing machine according to the invention, FIG. 2 shows a schematic diagram of an exemplary preparing device and storage tank of a formulation unit according to the invention, FIG. 3 shows a schematic diagram of a further exemplary preparing device and storage tank of a formulation unit according to the invention, FIG. 4 shows a schematic diagram of an exemplary formulation unit according to the invention, FIG. 5 shows a schematic diagram of an exemplary degassing device according to the invention, FIG. 6*a* shows schematically an exemplary dye package according to the invention, FIG. 6*b* shows schematically a further exemplary dye package according to the invention, FIG. 7 shows a schematic view of an exemplary dye dosing device according to the invention, FIG. 8 shows a schematic view of a further exemplary dye dosing device according to the invention, FIG. 9 shows a schematic view of a preferred embodiment of a dye package, FIG. 10 shows a schematic view of the dye package of FIG. 9 from a different perspective, FIG. 11 shows a schematic view of a further preferred embodiment of a dye package, FIG. 12 shows a schematic view of a further preferred embodiment of a dye package including a preferred seal, FIG. 13 shows a schematic view of a further preferred embodiment of a dye package, FIG. 14 shows a schematic view of a detail of a preferred dye dosing device, FIG. 15 shows a schematic view of a detail of the preferred dye dosing device of FIG. 14 including a section of a preferred dye package before step j), FIG. 16 shows a schematic view of a detail of the preferred dye dosing device of FIG. 14 including a section of a preferred dye package after step j), FIG. 17 shows a schematic view of a detail of the preferred dye dosing device of FIG. 14 during step k), FIG. 18 shows a flowchart of a preferred method to operate the dye dosing device of FIGS. 14 to 17.

FIG. 1 shows a schematic view of an exemplary inkjet printing machine 1 according to the invention. The inkjet printing machine 1 comprises a printing unit 10 and a formulation unit 20. The printing unit 10 comprises a printing device 11 moving along an axis and jetting ink onto a textile 15 which is supplied by means of a substrate supply device 12 to the printing device. The printing unit 10 further comprises an ink supply device 13 for supplying ink to the printing device 11.

The exemplary formulation unit 20 comprises eight preparation devices 30 for preparing ink. The number of preparation devices depends in particular on the number of inks which are used for print procedures and can vary according to the application of the inkjet printing machine. Also inkjet printing machines with a formulation unit having 1, 2, 3, 4, 5, 6, 7, 9, 10, 11, 12 or even more preparation devices 30 are possible. Each preparation device 30 is connected to a storage tank 50 which is, in the exemplary inkjet printing machine 1 constantly connected to the ink supply device 13 for supplying ink from the storage tank 50 to the printing device 11. In another not shown embodiment the storage tank 50 is not constantly connected to the inkjet printing machine 1. Such embodiments may comprise a second storage tank into which ink from the formulation unit 20 is supplied and which is constantly connected to the ink supply device 13.

A preparation device 30 comprises a preparation tank 32 for receiving the ingredients of the ink and at least one preparation pump 35*a* or preparation turbine 35*b* (both indicated in FIG. 1 by reference numeral 35) for mixing the ingredients in the preparation tank 32 and for pumping the ink into the storage tank 50.

The formulation unit has a control device 60 which may be integrated into the control device of the inkjet printing machine 1. When performing a manual preparation procedure, the operator enters for example the amount (for example 900 or 1000 g) and colour of the dye which is in the dye-package that he is going to use for the preparation of ink at the touch screen display of the control device 60. The control device 60, for example a PLC-control operates the different components at least of the formulation unit 20. Subsequently the relevant equipment of the preparation device 30 automatically measures the correct amount of deionised water and of the necessary additives and supplies these ingredients into the preparation tank 32. Then the preparation device 30 is operated to mix the ingredients for example by circulating the mixture by means of the preparation pump 35*a* or preparation turbine 35*b* until the dye is distributed homogenously, e.g. dissolved, which may take 5 minutes. Then the preparation device 30 of the formulation unit 20 automatically passes the ink through an ink filter 37 (shown in FIGS. 2 and 3) and into the storage tank 50. Preferably the ink filter 37 is a fine mesh filter with a mesh in the rage up to few micrometers. In one embodiment the preparation pump 35*a* is a self-priming membrane pump which is air-operated and has a positive displacement. With this kind of pump the cleanness of the preparation device 30 is facilitated.

FIG. 2 shows a schematic diagram of an exemplary preparing device 30 and storage tank 50 of a formulation unit 20 according to the invention. The work flow of this exemplary preparing device 30 is as follows: A dosing pump 34 passes a predetermined amount of water from a deionised water inlet 31 into a preparation tank 32. The amount of water dosed by the dosing pump 34 is controlled by the control device 60 (shown in FIG. 1). A dye dosing device 38 serves for dosing the dye which is also supplied from the dye dosing device 38 into the preparation tank 32. The dye can have a solid form e.g. a powder form or a granulated form or the dye can have a liquid form, as e.g. a colour-concentrate. The dye dosing device 38 is responsible for adjusting the concentration of the dye through exact volumetric addition and for supplying the dye as soon as a request comes from the control device 60. In the exemplary embodiment shown in FIG. 2, the dye dosing device 38 is arranged at a feed line 38*f* to the preparation tank 32.

For applications where the dye used requires further additives for the preparation of ink, the formulation unit 20 comprises an additive dosing device 39 (shown with dotted lines), which supplies a predetermined amount of additives, e.g. diluents and/or further chemicals into the preparation tank 32.

The preparation tank 32 of the exemplary embodiment is heatable as is especially beneficial for the solution of some kinds of dyes, in particular for dyes, preferably in form of a colour-concentrate having a high viscosity. In an exemplary embodiment a colour-concentrate with a very high viscosity is used. It becomes fluid when water is added and heated to 55 centigrade. When all ingredients are received in the preparation tank 32, the valve 36 is closed and the preparation pump 35*a* is activated. The preparation pump 35*a* circulates the mixture from the preparation tank 32 through the circulation tube 33 and back to the preparation tank 32 until the dye is distributed homogenously within the liquid. In one embodiment with about 2 liters capacity of the preparation tank and an ink volume of about 1.5 liters, the solution or dispersion circulation takes about five minutes for example.

After the circulation process is completed, the valve 36 is operated to close the connection to the circulation tube 33 and thereby to open the connection to an ink filter 37. Now, the preparation pump 35*a* passes the solution through the ink filter 37 and thereby out of the preparation unit 20.

The exemplary embodiment of the formulation unit shown in FIG. 2 further comprises a degassing device 48 which is arranged in the formulation unit 20 in the connection between the preparation unit 20 and the storage tank 50. Although the preparation of the ink by means of circulating the ingredients reduces the introduction of air into the ink, small air bubbles within the ink can still reduce the quality of the ink. The degassing device 48 which is arranged after the ink filter 37 extracts gasses from the ink before the ink is supplied into the storage tank 50 of the formulation unit 20. From the outlet 51 of the storage tank 50 the ink is supplyable to a printing device 10 of an inkjet printing machine 1 (shown in FIG. 1).

FIG. 3 shows a further schematic diagram of an exemplary preparing device 30 and storage tank 50 of a formulation unit 20 according to the invention. The exemplary preparing device 30 of FIG. 3 corresponds to a large extent to the exemplary preparing device 30 of FIG. 2, apart from comprising a preparation turbine 35*b* for mixing the ink. In the embodiment of FIG. 3, the mixing turbine 35*b* is installed within the circulation tube 33. The exemplary mixing turbine 35*b* comprises two propellers which, for preparing ink, drive the mixture of the ingredients in high speed manner through circulation tube 33 and preparation tank 32, respectively.

FIG. 4 shows a schematic diagram of a further exemplary formulation unit 20 according to the invention. The schematically shown formulation unit 20 comprises eight preparing devices 30. Such a formulation unit 20 with eight preparing devices 30 will for example have a size of approximately 1 meter length, 0.5 meter breadth and 1.2 meter height. A PLC control 60 will manage the dosing pump 34 at the inlet of deionised water, the preparation pump 35*a* and the valve 36 for switching the process from circulating the ingredients of the ink for solving them to the supply of the ink solution to the ink filter 37. FIG. 4 shows the use of a preparation pump 35*a* for mixing the ingredients of the ink. In the same way it is also possible to apply a preparation turbine 35*b* for mixing the ingredients of the ink.

For the preparation of ink with the examplaratory embodiment of the formulation unit 20 of FIG. 4 a prepacked dye in form of a colour powder is used, which is filled manually into the preparation tank 32. Also the additives required to prepare an ink are contained in a package which is filled manually into the preparation tank 32. Additionally a predetermined amount of deionised water has to be added, which is dosed by means of the dosing pump 34. Apart from the differences with filling the ingredients of the ink into the preparation tank 32, the procedure of preparing the ink with the formulation unit 20 is performed according to the workflow as described with reference to FIG. 2 and FIG. 3.

FIG. 5 shows a schematic diagram of an exemplary degassing device 48 according to the invention. The degassing device 48 is arranged between the preparation device 30 and the storage tank 50. After the preparation in the preparation tank 32 the ink goes through an ink filter 37 not shown in FIG. 5. For degassing the ink, a degassing pump 42 provides a continuous flow of the ink through a degassing component 43. The continuous flow may for example be 0.5 liters per minute; according to the ink preparation capacity of the formulation unit and/or the ink consumption capacity of the ink jetting process, the flow rate may vary accordingly. In an alternative embodiment it is also possible that the preparation pump 35*a* or the preparation turbine 35*b*, respectively provides a sufficient continuous flow of the ink through the degassing component 48. In such an embodiment an additional degassing pump 42 can be omitted.

The degassing component 43 is connected via vacuum piping 45 to a vacuum pump 44 which provides for below atmospheric pressure for example about 0.9 bar. As the prepared ink passes through the degassing component 43 most of the gaseous particles are expelled from the prepared ink. Subsequent the degassing procedure, the ink is conducted into the storage tank 50. To prevent a re-entry of gaseous components into the ink the storage tank 50 is for example designed as a vacuum buffer tank in which a below atmospheric pressure is maintained.

FIG. 6*a* shows schematically an exemplary dye package 70 according to the invention. The dye package 70 of FIG. 6*a* is of substantially cylindrical shape and contains a dye within its inner volume. The dye contained in the dye package 70 may have any suitable form from solid to liquid like powder, granulates, pastes, gels or fluids. In the exemplary embodiment the dye package has a top 71 comprising a perforated seal 72 which is discontinued at a top bending area 73 at which the top is permanently fixed to the main body of the dye package 70. The bottom 75 of the dye package 70 is designed corresponding to the top 71 of the dye package 70. The bottom 75 comprises a bottom perforated seal 74 which runs close to the edge of the bottom 75 and which allows the bottom 75 to open to the outside of the dye package 70 as soon as the pressure on the bottom 75 rises above a certain amount. The perforation ends at a bottom bending area 76 at which the bottom 75 is permanently fixed to the dye package 70. To prevent an unintentional break of the perforated seal 72, 74 it is advantageous to protect the top 71 and bottom 75 with an appropriate seal protecting means, for example a cap.

The perforated seals 72, 74 and the bending areas 73, 76 are adapted to empty the dye package 70 by means of a stamp (not shown) which presses on the top 71 and breaks the perforation of the top perforated seal 72. As a result of the increased pressure within the dye package 70 the perforation of the bottom perforated seal 74 breaks and the content of the dye package 70 is emptied at the bottom side of the dye package 70 to the outside. As the top and the bottom of the dye package 70 are fixed to the dye package at the top and bottom bending areas, there is no risk that parts of the dye package 70 end up within the dye. To allow for sliding the whole content of the dye package 70 into the preparation tank 32, the stamp should fit inside and slide along the side walls of the dye package 70.

In a special embodiment of the dye package 70 the top 71 comprises a rigid top element 71*a* with a seal 72*a* at its circumference without having a top bending area 73. The rigid top element 71*a* itself serves as a stamp which is connectable to an actuation means. By exerting pressure on the rigid top element 71*a* with the actuation means, the top seal 72*a* breaks and by further exerting pressure with the actuation means the bottom perforated seal 74 breaks and the dye contained within the dye package 70 slides at the bottom side out of the dye package 70. Preferably the circumference of the rigid top element 71*a* fits in and is well adapted to the inner wall of the dye package 70 for moving the dye completely out of the dye package 70. In a special embodiment the rigid element 71*a* may be provided with a lip for emptying the dye preferably free of residues.

With more free-flowing dyes, it suffices to maintain the pressure until the bottom perforation seal 74 is broken, in contrast, less free-flowing dyes have to be expelled by means of a stamp passing through the whole dye package 70. The dye package may be manufactured of any suitable material for example plastics, metals or coated paper board. In a special embodiment the wall of a dye package 70 is made from coated paper board and the top and bottom portions are made of metal as for example a pringle box.

FIG. 6*b* shows schematically a further exemplary dye package 70 according to the invention having an elliptic cross section. The advantage of an elliptic cross section is that the arrangement of the dye package 70 with regard to the rotational orientation is enhanced.

FIG. 7 shows a schematic view of an exemplary dye dosing device 38*a* according to the invention. The dye dosing device 38*a* is arranged within the preparation tank 32 of which a detail of the wall is shown in FIG. 7. The dye dosing device 38*a* is in one embodiment fixedly connected to the preparation tank 32. In another embodiment it is also possible to have the dye dosing device 38*a* as an additional kit for the preparation device 30 which can be mounted at the preparation tank 32 depending on the employed dye supply.

Dye packages 70 are insertible into the dye dosing device 38*a* through an opening 32*a* in the wall of the preparation tank 32 which is open- and closeable by means of a cover (not shown). The dye dosing device 38*a* comprises a steel frame 80 which has substantially a cylindrical form and which is open to the upper circumferential side. At the bottom side the steel frame 80 comprises a stopper 81 which serves to support the dye package within the dye dosing device 38*a*. The stopper 81 also serves for preventing the bottom perforated seal 74 to break beyond the bottom bending area 76 and thus preventing the bottom 75 of the dye package 70 to enter the preparation tank 32. A view of the bottom 75 of the dye package 70 is shown at the lower left side of FIG. 7.

An actuator 82 is connected to a stamp 83 or to a rigid top element 71*a* arranged at the top of the dye package 70. By moving the actuation means 82, 83 or 71*a* in the direction from the top 71 to the bottom 75 of the dye package 70, the top perforation seal 72 breaks and as a result of further movement and rising pressure within the dye package 70 also the bottom perforation seal 74 breaks and thus the dye within the dye package 70 slides into the preparation tank 32. For facilitating the flow of the dye out of the package, the dye dosing device 38*a* of this exemplary embodiment is arranged inclined to the horizontal.

FIG. 8 shows a schematic view of a further exemplary dye dosing device according to the invention. The dye dosing device 38*b* is arranged at the outside wall of the preparation tank 32 of which a detail is shown in FIG. 8. Dye packages 70 are vertically insertible into the dye dosing device 38*b*. At the bottom side of the inserted dye packages 70, the dye dosing device 38*b* is arranged at the preparation tank 32. Located here, an opening 32*a* is arranged in the wall of the preparation tank 32 which is open- and closeable by means of a cover (not shown). The opening comprises in particular a seal 32*b* to receive the bottom of a dye package 70 preferably dust- and/or spill-tight. After dosing the dye, the opening is closed for preparing the ink.

The dye dosing device 38*b* comprises a steel frame 80 having an elliptic form which is open to the upper circumferential side. (See lower left side of FIG. 8.) This facilitates the insertion of a likewise elliptic dye package 70 at the corresponding rotational position. At the bottom side also the steel frame 80 of the embodiment of FIG. 8 comprises a stopper 81 which prevents the dye package to enter the preparation tank 32. Stopper 81 also serves for preventing the bottom perforated seal 74 to break beyond the bottom bending area 76 and thus preventing the bottom 75 of the dye package 70 to enter the preparation tank 32. Also for this embodiment it is also possible to provide the dye dosing device 38*a* as an add-on kit for the preparation device 30 which can be mounted at the preparation tank 32.

In this exemplary embodiment a security label 90 is arranged at the dye package 70. On this security label 90 data respective to the content of the dye package 70 is stored. The dye dosing device 38*b* comprises further a label reader 91 which reads the data stored on the security label 90. The data is transmitted to the control device 60 (see FIGS. 1, 3) and by controlling the data it can be ensured that the dye package 70 comprises the requested content.

FIG. 9 shows a schematic view of a preferred embodiment of a dye package. The collapsible package 70 has a main body with several harmonica type wall sections 90, with a flat package bottom and with the dye release opening 87 essentially parallel to the package bottom. The dye release opening 87 may be covered by a seal 72 or a removable lid. A cross-section, which is essentially perpendicular to the flat package bottom, of the main body is essentially trapezoid, in particular when the dye package 70 is filled with dye and the dye release opening 87 is covered. The collapsible package 70 may be transferred from a first state (as shown) into its collapsed state, in particular by a stamp of the dye dosing device, while releasing the dye. The collapsible package 70 may be stacked conveniently in the dye dosing device and may be unstacked by the formulation unit.

FIG. 10 shows a schematic view of the dye package 70 of FIG. 9 from a different perspective. The figure shows the main body with its harmonica type wall sections 90 and the flat package bottom in its first state.

FIG. 11 shows a schematic view of a further preferred embodiment of a dye package 70. The main body of the dye package 70 is essentially cylindrical and extends along a longitudinal axis. The lid of the dye package 70 is removed from the essentially cylindrical dye release opening 87. Through the dye release opening 87 the movable piston 93 can be seen which may be imposed by a stamp and which helps to release the dye from the dye package 70.

FIG. 12 shows a schematic view of a further preferred embodiment of a dye package 70 including a preferred seal 72. The main body of the dye package 70 is quite similar to the main body of FIG. 11. The dye release opening 87 is partly closed by the seal 72 which is sectionally connected to a wall of the dye package 70. The seal 72 comprises a sealing section 88 and a strap 89 which serves to sectionally separate of the sealing section 88 from the main body.

FIG. 13 shows a schematic view of a further preferred embodiment of a dye package 70. The main body of the dye package 70 comprises an essentially cylindrical dye release opening 87 or first end, extends along the longitudinal axis and has a hexagonal cross-section essentially perpendicular to the longitudinal axis. By the hexagonal cross-section, a higher talk about its longitudinal axis may be applied to to the dye package 70 while connecting it to the formulation unit or one of its dye dosing devices.

FIG. 14 shows a schematic view of a detail of a preferred dye dosing device 38. The dye dosing device 38 comprises a package connector 84 for accepting a section of one of the dye packages 70, a cutter 85 for opening the dye package 70 and a sprinkler 86 for directing a liquid towards the dye package 70.

The package connector 84 comprises a socket 94 for accepting a wall section of the dye package 70 and the dye release opening 87. The socket 94 comprises a socket thread 95 for accepting the locking projection of the dye package 70 as well as the locking element to releasably engage with the locking projection. The socket 94 also comprises an opening through which the dye may be fed to the preparation tank or feed line.

The cutter 85 is provided with a blade 97 and arranged to move the blade 97 to follow a circular path to cut the seal of the dye package accepted by the socket 94. Preferably, the circular path is restricted to an angle between 180° and 345°, more preferably approximately 280°. The cutter is provided to cut the seal of the dye container. The blade 97 is arranged at an angle to the plane of the circular arc part, i.e. the plane of the sealing section. The cutter 85 serves to at least sectionally open a wall section of the dye package or seal of the dye package.

The sprinkler 86 is provided to direct the liquid towards the seal and into the dye package to improve the release of the dye. Also, the sprinkler 86 is provided to direct the liquid towards the preparation tank or feed line which may improve the transport of the dye. The sprinkler 86 is arranged adjacent to the socket 94.

FIG. 15 shows a schematic view of a detail of the preferred dye dosing device 38 of FIG. 14 including a section of a preferred dye package 70 before step j). The explanations referring to the dye dosing device 38 of FIG. 14 apply. The dye container 70 comprises an essentially circular dye release opening 87 (not shown) which is closed by a seal (not shown) and the locking projection 92. The locking projection 92 is intended to be accepted by the socket thread 95.

FIG. 16 shows a schematic view of a detail of the preferred dye dosing device of FIGS. 14 and 15 including a section of a preferred dye package 70 after step j). The explanations referring to the dye dosing device 38 of FIGS. 14 and 15 apply as well as the explanations referring to the preferred by dye package 70. Here, the locking projection 92 is accepted by the socket thread 95. The dye package 70 has not been rotated yet about its longitudinal axis and the locked state is not yet achieved.

FIG. 17 shows a schematic view of a detail of the preferred dye dosing device 38 of FIGS. 14, 15 during step k). The explanations referring to the dye dosing device 38 of FIGS. 14 and 15 apply. The cutter 85 is in the process to open the seal 72 at least in sections. The blade 97 has travelled a part of its circular path and has cut the seal 72 along a certain distance.

FIG. 18 shows a flow chart of a preferred method to operate the dye dosing device of FIGS. 14 to 17. The preferred method comprises the steps:

j) introducing one of the dye packages into the package connector, preferably into the socket, preferably introducing the locking projection of the dye package into the socket thread, preferably rotating the dye package about its longitudinal axis into the locked state, k) opening the dye package, particularly cutting the seal of the dye package within the socket and/or the second end of the dye package, with the cutter, particularly moving a blade of the cutter along the circular arc or path covering an angle between 180° and 345°, l) directing the liquid towards the seal or into the dye package with the sprinkler for improved release of the dye from the dye package, preferably, as indicated by dashed boxes, with at least one of the steps m) directing the liquid towards the seal with the sprinkler to remove dirt from the outside of the seal, preferably before step k), and/or n) directing the liquid also towards the preparation tank or feed line with the sprinkler to promote the transport of the dye, preferably during step l), and/or o) discharging liquid from the formulation unit or from the dye dosing device to dispose of dirt from the outside of seal, preferably before step k), preferably after or during step m), and/or p) removing the dye package from the package connector, preferably after releasing the locking projection, preferably after emptying the dye package.

REFERENCE NUMERALS

1 inkjet printing machine
10 printing unit
11 printing device
12 substrate supply device
13 ink supply device
15 textile
20 formulation unit
30 preparation device
31 water inlet
32 preparation tank
**32*a*** opening
**32*b*** seal
33 circulation tube
34 dosing pump
35 preparation pump, preparation turbine
**35*a*** preparation pump
**35*b*** preparation turbine

36 valve
37 ink filter
38, 38*a* dye dosing device
38*f* feed line
39 additive dosing device
42 degassing pump
43 degassing component
44 vacuum pump
45 vacuum piping
48 degassing device
50 storage tank
51 outlet of the storage tank
60 control device
70 dye package
71 top
71*a* top element
72, 72*a* seal
73 top bending area
74 seal
75 bottom
76 bottom bending area
80 steel frame
81 stopper
82 actuation means
83 stamp
84 package connector
85 cutter
86 sprinkler
87 dye release opening
88 sealing section of seal 72
89 strap of seal 72
90 foldable section of dye package 70
91 planar wall section of dye package 70
92 locking projection of dye package 70
93 piston, disk
94 socket
95 socket thread
96 locking element
97, 97*a* blade of cutter

The invention claimed is:

1. A formulation unit for an inkjet printing machine, comprising
at least two preparation devices for preparation of same or different ink connected with
at least two storage tanks for storing the prepared ink,
wherein the at least two storage tanks are connectable to an ink supply device of a printing unit of the inkjet printing machine for supplying the same of different ink from the at least two storage tanks to a printing device of the inkjet printing machine,
wherein each of the at least two preparation devices comprises
a preparation tank for receiving ingredients of the ink and
a preparation pump or a preparation turbine for circulating the ingredients in a mixing procedure before the ink is supplied into one of the at least two storage tanks,
wherein the ingredients comprise water and a dye.

2. The formulation unit of claim 1, wherein the connection from the at least two storage tanks to the printing device is adapted to supply the ink continuously from the storage tank to the printing device during a printing process.

3. The formulation unit of claim 1, wherein each of the at least two preparation devices is adapted to prepare the ink and to supply the ink to one of the at least two storage tanks while the ink is supplied from said storage tank to the printing device.

4. The formulation unit of claim 1, wherein each of the at least two preparation devices comprises a circulation tube for circulating the ingredients filled in the preparation tank.

5. The formulation unit of claim 1, wherein the preparation pump or preparation turbine is configured for mixing the ingredients in the preparation tank and for pumping the ink into one of the at least two storage tanks.

6. The formulation unit of claim 1, wherein each of the at least two preparation devices comprises a dye dosing device, which is designed to receive a dye package and to empty a content of the dye package into the preparation tank or a feed line thereto.

7. The formulation unit of claim 6, wherein the dye dosing device is configured for automatically dosing the dye and supplying the dye into the preparation tank, a water inlet, and a metering equipment for automatically delivering a predetermined amount of the water from the water inlet into the preparation tank.

8. The formulation unit of claim 6, wherein the dye package is designed as a capsule, a casing, a cartridge, a soft pack, a blister or can optionally comprise a predetermined breaking point for emptying the dye package.

9. The formulation unit of claim 6, wherein the dye package comprises a security label containing data and the formulation unit further comprises a label reader for reading the data.

10. The formulation unit of claim 1, wherein, in operation of the printing device, the at least two storage tanks are constantly connected to the printing device.

11. The formulation unit of claim 1, wherein the at least two preparation devices are adapted to prepare the ink and to supply the ink to the at least two storage tanks, while the ink is supplied from the at least two storage tanks to the printing device.

12. The formulation unit of claim 1, wherein each of the at least two preparation devices comprises an ink filter for filtering the prepared ink.

13. The formulation unit of claim 1, further comprising at least two degassing devices, which are arranged between the at least two preparation devices and the at least two storage tanks.

14. The formulation unit of claim 13, wherein the at least two degassing devices comprise at least two degassing components where the ink is subjected to below atmospheric pressure.

15. The formulation unit of claim 13, wherein the at least two storage tanks are buffer vacuum containers, which are connected directly to an ink inlet of the printing device.

16. The formulation unit of claim 6, wherein the dye dosing device comprises a package connector for accepting a section of the dye package, a cutter for opening the dye package and a sprinkler for directing a liquid towards the dye package.

17. An inkjet printing machine comprising:
the formulation unit of claim 1 and a printing unit comprising
a printing device for jetting ink onto a substrate,
an ink supply device for supplying ink to the printing device, and
a substrate supply device for supplying the substrate to the printing device.

18. The inkjet printing machine of claim 17, wherein the substrate is a textile.

19. A method for preparing an ink using the formulation unit for an inkjet printing machine of claim 1, comprising filling the preparation tank with a first amount of deionized water;

adding a predetermined amount of the dye or colour;

mixing the ingredients filled into the preparation tank;

adding a second amount of deionized water; and further mixing the ingredients filled into the preparation tank.

20. A method for preparing an ink using the formulation unit for an inkjet printing machine of claim 1, comprising filling the preparation tank with a first amount of deionized water;

adding a predetermined amount of one or more additive chemicals;

adding a predetermined amount of the dye;

mixing ingredients filled into the preparation tank;

adding a second amount of deionized water; and further mixing the ingredients filled into the preparation tank.

* * * * *